US008730281B2

(12) United States Patent
Akimoto et al.

(10) Patent No.: US 8,730,281 B2
(45) Date of Patent: May 20, 2014

(54) IMAGE DISPLAY DEVICE

(71) Applicant: Japan Display East Inc., Tokyo (JP)

(72) Inventors: Hajime Akimoto, Ome (JP); Yoshirou Mikami, Hitachiota (JP); Kiyoshige Kinugawa, Mutsuzawa (JP); Shigeyuki Nishitani, Mobara (JP); Takeo Shiba, Kodaira (JP)

(73) Assignees: Japan Display Inc., Tokyo (JP); Panasonic Liquid Crystal Display Co., Ltd., Hyogo-ken (JP)

( * ) Notice: Subject to any disclaimer, the term of this patent is extended or adjusted under 35 U.S.C. 154(b) by 0 days.

(21) Appl. No.: 13/942,068

(22) Filed: Jul. 15, 2013

(65) Prior Publication Data

US 2013/0293601 A1 Nov. 7, 2013

Related U.S. Application Data

(63) Continuation of application No. 13/330,416, filed on Dec. 19, 2011, now Pat. No. 8,508,562, which is a continuation of application No. 12/314,422, filed on Dec. 10, 2008, now Pat. No. 8,102,387, which is a continuation of application No. 11/197,678, filed on Aug. 5, 2005, now Pat. No. 7,468,715, which is a continuation of application No. 10/212,046, filed on Aug. 6, 2002, now Pat. No. 6,950,081.

(30) Foreign Application Priority Data

Oct. 10, 2001 (JP) ..... 2001-312116

(51) Int. Cl.
*G09G 5/10* (2006.01)

(52) U.S. Cl.
USPC ..... 345/691; 345/76; 345/204

(58) Field of Classification Search
USPC ..... 345/76–79, 89–100, 204–215, 690–699
See application file for complete search history.

(56) References Cited

U.S. PATENT DOCUMENTS 5,198,803 A 3/1993 Shie et al.
5,293,159 A 3/1994 Bassetti, Jr. et al.

(Continued)

FOREIGN PATENT DOCUMENTS

JP 04-345072 12/1992
JP 7-507403 Y 12/1993

(Continued)

OTHER PUBLICATIONS

R.M.A. Dawson, Z. Shen, D.A. Furst, S. Connor, J. Hsu, M.G. Kane, R.G. Stewart, A. Ipri, C.N. King, P.J. Green, R.T. Flegal, S. Pearson, W.A. Barrow, E. Dickey, K. Ping, C.W. Tang, S. Van Slyke, F. Che, J. Shi, J.C. Sturm, M.H. Lu, "Design of an Improved Pixel for a Polysilicon Active-matrix Organic LED Display", SID Digest 1998, pp. 11-14.

*Primary Examiner* — Vijay Shankar
(74) *Attorney, Agent, or Firm* — Stites & Harbison PLLC; Juan Carlos A. Marquez, Esq.

(57) ABSTRACT

The invention provides an image display device that has an especially satisfactory display quality for animated images, and sufficiently suppresses the irregularities of display quality among pixels. The image display device includes a light emitting drive means that drives a light emitting means, based on an analog display signal inputted to the pixels, and a light emitting control switch for controlling a light-on or light-off of the light emitting means on one end of the light emitting drive means in each pixel.

3 Claims, 17 Drawing Sheets

(56) References Cited

U.S. PATENT DOCUMENTS

| | | | | |
|---|---|---|---|---|
| 6,169,532 | B1 | 1/2001 | Sumi et al. | |
| 6,525,709 | B1 | 2/2003 | O'Callaghan | |
| 6,583,775 | B1 | 6/2003 | Sekiya et al. | |
| 6,628,258 | B1 | 9/2003 | Nakamura | |
| 6,636,191 | B2 | 10/2003 | Cok | |
| 6,777,888 | B2 | 8/2004 | Kondo | |
| 6,859,193 | B1 | 2/2005 | Yumoto | |
| 6,950,081 | B2 * | 9/2005 | Akimoto et al. | 345/55 |
| 7,002,536 | B2 | 2/2006 | Tam | |
| 7,129,918 | B2 | 10/2006 | Kimura | |
| 7,456,579 | B2 | 11/2008 | Yamazaki et al. | |
| 7,468,715 | B2 | 12/2008 | Akimoto et al. | |
| 8,102,387 | B2 | 1/2012 | Akimoto et al. | |
| 8,508,562 | B2 * | 8/2013 | Akimoto et al. | 345/690 |
| 2001/0024186 | A1 | 9/2001 | Kane et al. | |
| 2001/0028226 | A1 | 10/2001 | Malaviya et al. | |
| 2002/0044110 | A1 | 4/2002 | Prache | |
| 2002/0044140 | A1 | 4/2002 | Inukai | |
| 2002/0118158 | A1 | 8/2002 | Yamamoto et al. | |
| 2003/0230750 | A1 | 12/2003 | Koyama et al. | |
| 2005/0190177 | A1 | 9/2005 | Yumoto | |

FOREIGN PATENT DOCUMENTS

| | | | |
|---|---|---|---|
| JP | 10-312173 | Y | 11/1998 |
| JP | 2001-083924 | Y | 3/2001 |
| WO | WO 93/24921 | Y | 12/1993 |

* cited by examiner

STRUCTURE OF RESET TFT SWITCH 41

STRUCTURE OF OLED DRIVE TFT 4 AND LIGHT-ON TFT SWITCH 42

IMAGE DISPLAY DEVICE

This application is a Continuation application of U.S. application Ser. No. 13/330,416 filed Dec. 19, 2011, which is a Continuation application of U.S. application Ser. No. 12/314,422 filed Dec. 10, 2008, which is a Continuation of U.S. application Ser. No. 11/197,678 filed Aug. 5, 2005, which is a Continuation application of U.S. application Ser. No. 10/212,046 filed on Aug. 6, 2002; and U.S. application Ser. No. 11/197,678 filed Aug. 5, 2005, is a sibling application to the U.S. application Ser. No. 11/042,054 filed Jan. 26, 2005. Priority is claimed based upon U.S. application Ser. No. 13/330,416 filed Dec. 19, 2011, which claims the priority of U.S. application Ser. No. 12/314,422 filed Dec. 10, 2008, which claims the priority of U.S. application Ser. No. 11/197,678 filed Aug. 5, 2005, which claims the priority date of U.S. application Ser. No. 10/212,046 filed on Aug. 6, 2002, which claims the priority date of Japanese Patent Application 2001-312116 filed on Oct. 10, 2001, all of which is incorporated by reference.

BACKGROUND OF THE INVENTION

1. Field of the Invention

The present invention relates to an image display device that provides a high quality image display. The invention specifically relates to an image display device that possesses an especially satisfactory display quality of animated images of the like and sufficiently suppresses the irregularities of display quality between pixels.

2. Background of the Invention

A conventional technique will be described with reference to FIG. 23 and FIG. 24.

FIG. 23 illustrates a pixel configuration of a poly-silicon TFT light emitting display device that uses the conventional technique. Pixels each having an organic light emitting diode (OLED) 207 as a pixel luminous object are arrayed on a display unit in a matrix form. However, FIG. 23 illustrates only one pixel in order for simplification. The pixel 210 is connected to an external drive circuit through a selection line 211, a data line 217, a power supply line 218, and so forth. In the pixel 210, the data line 217 is connected to one end of a canceling capacitor 202 through an input TFT 201. The other end of the canceling capacitor 202 is connected to the gate of a drive TFT 204, one end of a storage capacitor 203, and one end of an AZ switch 205. The other end of the storage capacitor 203 and one end of the drive TFT 204 are commonly connected to the power supply line 218. The other ends of the drive TFT 204 and the AZ switch 205 are commonly connected to one end of an AZB switch 206. The other end of the AZB switch 206 is connected to a common power supply through the OLED 207. Here, the AZ switch 205 and the AZB switch 206 are formed on the TFT, and the gates of these switches are connected to an AZ line 215 and an AZB line 216.

Next, the operation of this conventional example is explained with reference to FIG. 24. FIG. 24 illustrates the drive waveforms of the data line 217, the AZ switch 205, the AZB switch 206, and the input TFT 201, when a display signal is inputted to the pixel. Since the pixel is composed of the p-channel TFTs, the upper (high voltage) side of the drive waveforms in FIG. 24 corresponds to the TFT being OFF, and the lower (low voltage) side corresponds to the TFT being ON.

First, at the timing (1) shown in FIG. 24, the input TFT 201 is turned ON, the AZ switch 205 is turned ON, and the AZB switch 206 is turned OFF. Thereby, the zero (reference) level signal voltage that has been inputted to the data line 217 is inputted to one end of the canceling capacitor 202. At the same time, the voltage across the gate and source of the drive TFT 204 being put into a diode connection by the AZ switch 205 (turned ON) is reset to the voltage of the power supply line 218+Vth. Here, the Vth represents the threshold voltage of the drive TFT 204. When the zero level signal voltage is inputted, this operation automatically brings the pixel into the zero bias such that the gate voltage of the drive TFT 204 becomes just the threshold voltage.

Next, at the timing (2) shown in FIG. 24, the AZ switch 205 is turned OFF, and a signal voltage of a specific analog level is inputted to the data line 217. Thereby, the specific level signal voltage is inputted to one end of the canceling capacitor 202. By this operation, the gate voltage of the drive TFT 204 varies by an additional amount over the specific level of signal, in comparison to the condition at the timing of the automatic zero bias.

Next, at the timing (3) shown in FIG. 24, the input TFT 201 is turned OFF, the AZB switch 206 is turned ON. Thereby, the specific level of signal that has been applied by the input TFT 201 being ON is stored into the canceling capacitor 202. By this operation, the gate of the drive TFT 204 is fixed to a state that the voltage thereof varies by an amount that the specific level of signal is added to the threshold voltage. Further, the signal current (driven by the drive TFT 206) drives the OLED 207 to emit at a brightness corresponding to the specific voltage level of the inputted signal. The conventional technique of this sort is disclosed in detail, for example, in the Digest of Technical Papers, SID 98, pp. 11 through 14, etc.

The conventional technique can not provide an especially satisfactory display quality of animated images or sufficiently suppresses the irregularities of display quality between pixels.

The conventional example described with FIG. 23 and FIG. 24 introduces the canceling capacitor 202 and the AZ switch 205, and the AZB switch 206 to absorb the Vth irregularities of the drive TFT 204 into the voltage across the canceling capacitor 202. Thus, the conventional example realizes an analog display with reduced irregularities of brightness in the OLED 207. The conventional example does not concern a satisfactory display quality of animated images. That is, the emission of the OLED 207 starts from the moment of the AZB switch 206 being turned ON, which is illustrated before the timing (3) in FIG. 24, and is continued for virtually one frame, till the moment of the input TFT 201 being turned ON before the timing (1) in the next frame. However, in such a display method, the human eyes are apt to detect the images for continuing two frames so as to visually superimpose them, owing to the afterimage effect of the visual property, which will present unnatural animated images referred as frame retaining.

Although the conventional technique is able to cancel the Vth irregularities of the drive TFT 204 as mentioned above, the characteristic irregularities of the drive TFT 204 are not limited to the Vth irregularities. The conventional technique attains the drive current of the OLED 207 by the current output of the drive TFT 204. This means that the conventional technique also produces brightness unevenness like gain irregularities in each of the pixels, even if the Vth irregularities of the drive TFT 204 can be cancelled (if there are the irregularities of current drive capability due to the irregularities of mobility in the drive TFT 204). Generally, there are large irregularities between individual devices of the TFTs, and it is very difficult to suppress the irregularities between the individual devices, especially when multiple TFTs are packed in a pixel. In case of the low temperature polycrystalline silicon TFT process, for example, the irregularities of mobility are known to appear in about ten percents. Therefore, the conventional technique can not sufficiently suppress the generation of brightness unevenness due to irregularities of display quality between the pixels.

SUMMARY OF THE INVENTION

The foregoing problem that animated images present unnaturally, such as the frame retaining, can be solved by an image display device includes: a display unit composed of plural pixels each having a light emitting means, a signal line for inputting an analog display signal to the pixels, a light emitting drive means for driving the light emitting means based on the analog display signal, and a light emitting control switch means for controlling a light-on or a light-off of the light emitting means disposed between the light emitting drive means and the light emitting means in each of the pixels.

The light emitting control switch means makes it can set a non-emission period of light between two consecutive frames by controlling a light-on time of the light emitting means in one frame. By setting an appropriate non-emission period of light, the afterimage effect that had appeared on the human visual property will lessen sufficiently within this non-emission period of light. Accordingly, the images for continuing two frames will not be superposed visually as mentioned above, which permits a smooth animated image display.

The problem that it is difficult to sufficiently suppress the generation of brightness unevenness due to the irregularities of display quality between the pixels can be solved by an image display device including a display unit composed of plural pixels each having a light emitting means, a signal line for inputting an analog display signal to the pixels, and a light emitting drive means for driving the light emitting means based on the analog display signal. The light emitting drive means provided to each of the pixels is a field effect transistor. The signal line is connected to the gate of the field effect transistor through at least one capacitance means. One of the source or the drain of the field effect transistor is connected to a power supply means through a switch, and the other of the source and the drain is directly connected to one of the light emitting means and the power supply means. The field effect transistor is contracted to apply one of the analog display signal and a virtually triangular pulse signal to the gate thereof through the capacitance means.

This construction controls a light-on period of the light emitting means at a point of time by the value of the analog signal voltage written in the capacitance means of each pixel so as to achieve a gradation display for animated images or the like. Therefore, it is possible to sufficiently suppress the irregularities of display quality between the pixels, which was the problem for the conventional technique that attains a gradation display by analogously controlling the emission intensity of the light emitting means.

BRIEF DESCRIPTION OF THE DRAWINGS

The foregoing and additional features and characteristics of the present invention will become more apparent from the following detailed description considered with reference to the accompanying drawings in which like reference numerals designate like elements and wherein.

DETAILED DESCRIPTION OF THE PREFERRED EMBODIMENTS

First Embodiment

The first embodiment of the invention is described with reference to FIG. 1 through FIG. 3.

First, the total construction of this embodiment is discussed with reference to FIG. 1.

Figure 1:
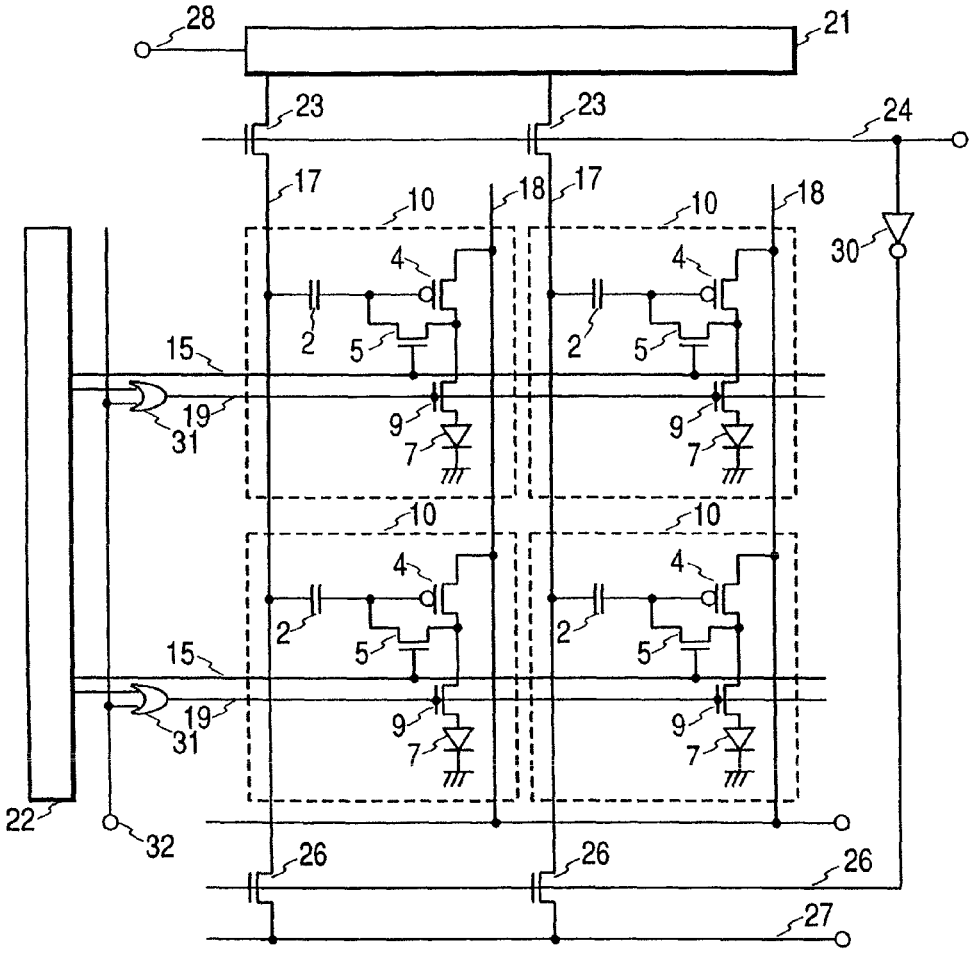
FIG. 1 is a structure configuration of an OLED display panel in the first embodiment of the present invention.

FIG. 1 illustrates a configuration of an OLED (Organic Light Emitting Diode) display panel of the first embodiment. Pixels 10, each having an OLED 7 as a pixel luminous object, are arrayed in a matrix form on a display unit. Each pixel is connected to the drive circuits furnished surrounding the display unit through a reset line 15, signal line 17, and a light-on switch line 19, etc. The reset line 15 is connected to the scanning output of a gate drive circuit 22, the signal line 17 is connected to a signal drive circuit 21 through a signal input switch 23, and to a triangular pulse input line 27 through a triangular pulse input switch 26. To the signal drive circuit 21 is connected a signal input line 28 that inputs an analog signal voltage. Since the signal drive circuit 21 is an analog signal voltage distribution circuit configured with generally known shift registers and analog switches, its details are omitted here.

The signal input switch 23 is alternated by a signal select line 24, and the triangular pulse input switch 26 is alternated by an inverted signal select line 25 (being the inverted output of the signal line 24 by an inverter circuit 30) such that the two switches are turned on alternately. The light-on switch line 19 is outputted from a light-on switch OR gate 31. To the light-on switch OR gate 31 are inputted the scanning output of the gate drive circuit 22 and a light-on control line 32. Since the gate drive circuit 22 is made up with generally known shift registers, its details thereof are omitted. Here, all the circuits of the pixel 10, the gate drive circuit 22, and the signal drive circuit 21, etc., illustrated in FIG. 1 are formed on a glass substrate by using the generally known low temperature polycrystalline silicon TFTs. In each pixel, the signal line 17 is connected through a pixel capacitor 2 to the gate of an OLED drive TFT 4 being a p-channel MOS transistor. The source of the OLED drive TFT 4 is connected to a power supply line 18. The drain of the OLED drive TFT 4 is connected by way of a light-on TFT switch 9 controlled by the light-on switch line 19 to one end of the OLED 7. The other end of the OLED 7 is connected to the common ground. Further, a reset TFT switch 5 that is controlled by the reset line 15 is furnished across the gate and the drain of the OLED drive TFT 4.

Next, the operation of this embodiment is discussed with reference to FIG. 2 and FIG. 3.

Figure 2:
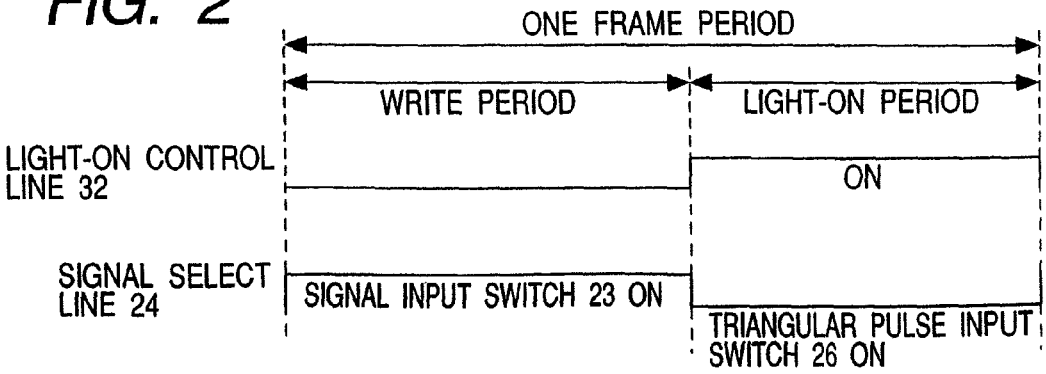
FIG. 2 shows the waveforms of the light-on control line and a signal select line of the first embodiment.

FIG. 2 illustrates the operation waveform of the light-on control line 32 and the signal select line 24 in one frame period in this embodiment. The one frame period is predetermined as 1/60 second in this embodiment, which is divided into "write period" (i.e., light-off period or non-emission period of light) in the first half and "light-on period" in the latter half. The rate of this division is specified, for example, 10%-90% to the "write period and 90%-10% to the "light-on period", or preferably as 50% each to the "write period" and the "light-on period." The light-on control line 32 is turned OFF during the "write period," but it is turned ON during the "light-on period." Thereby, the light-on control line 32 fixes the light-on TFT switches 9 of all the pixels into the ON state simultaneously through the light-on switch lines 19. Further, the signal select line 24 is turned ON during the "write period," and is turned OFF during the "light-on period." Thereby, the signal select line 24 turns the signal input switches 23 into ON during the "write period" and OFF during the "light-on period," and turns the triangular pulse input switches 26 into OFF during the "write period" and ON during the "light-on period". Thus, into the signal lines 17 is written the analog signal voltage during the "write period" through the signal drive circuit 21, and is written the triangular pulse voltage during the "light-on period" through the triangular pulse input line 27.

Figure 3:
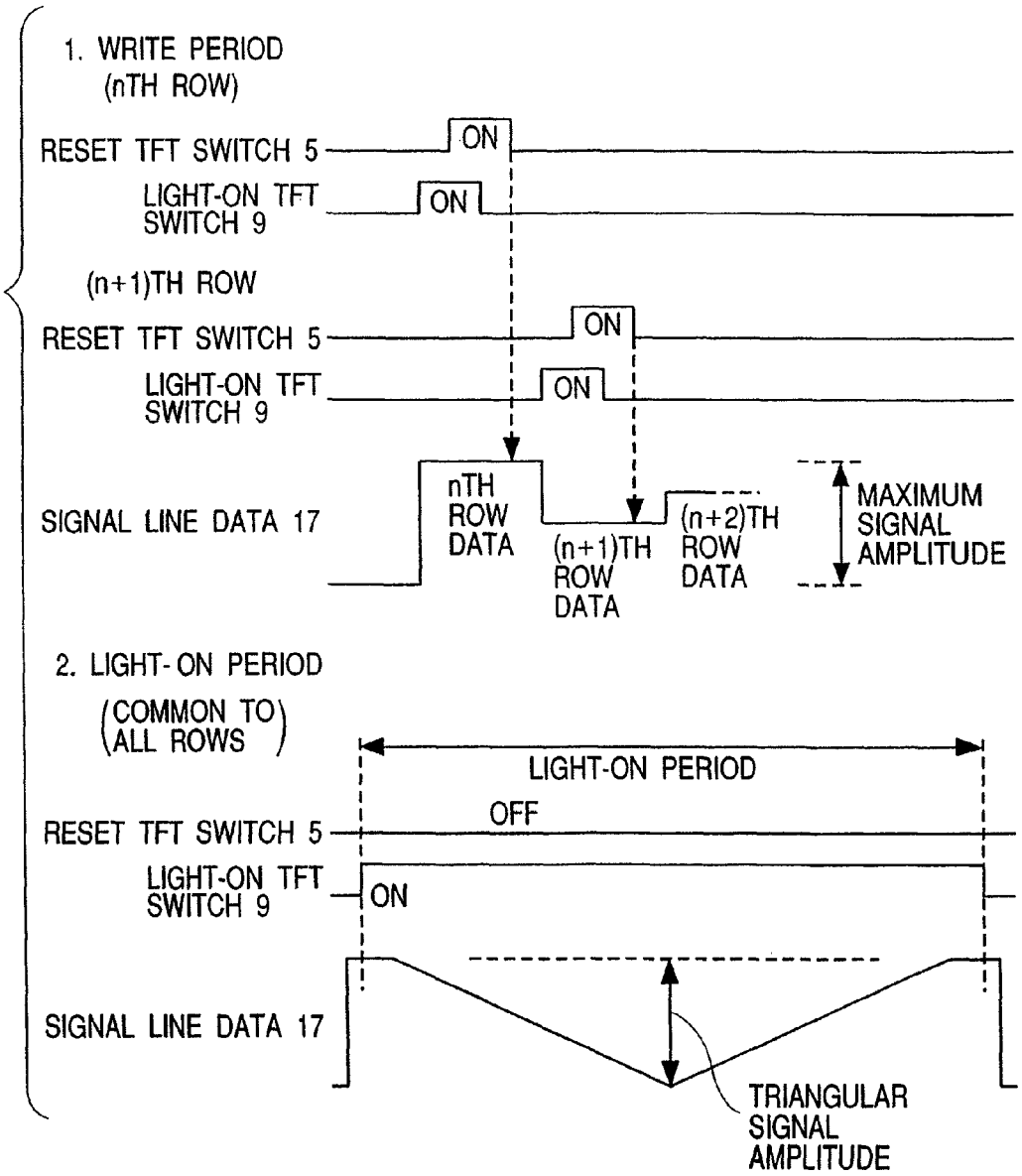
FIG. 3 shows a waveform timing chart of the drives to the switches and the inputs of the signal line data of the first embodiment.

FIG. 3 illustrates the waveform timing of drive of the reset TFT switch 5, of the light-on TFT switch 9, and of the data input on the signal line 17 in each pixel during the "write period" and the "light-on period."

During the "write period" being the first half of one frame, the gate drive circuit 22 sequentially scans the pixels by each row. Synchronously, the signal drive circuit 21 writes the analog signal voltage into the signal lines 17 as signal data. In particular, in the pixel on the n-th row selected by the gate drive circuit 22, the light-on TFT switch 9 is turned ON first, and then the reset TFT switch 5 is turned ON. As both the switches are turned ON, the OLED drive TFT 4 is put into a diode connection with the same potential applied across the gate and the drain therein. Accordingly, applying a specific voltage to the power supply line 18 in advance will put the OLED drive TFT 4 and the OLED 7 into the conductive state. Next, as the light-on TFT switch 9 is turned OFF, the OLED drive TFT 4 and the OLED 7 are forcibly put into the OFF state. At this moment, since the gate and the drain of the OLED drive TFT 4 are short-circuited through the reset TFT switch 5, the gate voltage of the OLED drive TFT 4 whose gate is connected to one end of the pixel capacitor 2 is automatically reset to a voltage lower by the threshold voltage Vth than the voltage of the power supply line 18. At this moment, the analog signal voltage is inputted as the signal line 17 data to the other end of the pixel capacitor 2. Next, as the reset TFT switch 5 is turned OFF, the potential difference between both ends of the pixel capacitor 2 is stored to remain intact in the pixel capacitor 2. In other words, when a voltage equal to the analog signal voltage is inputted to one end of the pixel capacitor 2 on the side of the signal line 17, the gate voltage of the OLED drive TFT 4 is forcibly set to a voltage lower by the threshold voltage Vth than a voltage of the power supply line 18. At this time, if a voltage level inputted to one end of the pixel capacitor 2 on the side of the signal line 17 is higher than the analog signal voltage, the OLED drive TFT 4 is OFF, and if the voltage level is lower than the analog signal voltage, the OLED drive TFT 4 is ON. However, during the period of scanning the pixels of the other rows, the light-on TFT switch 9 of the concerned pixel is always OFF. Accordingly, the OLED 7 will not light up regardless of the high or low of the data voltage on the signal line 17. In this manner, the writing of the analog signal voltage into the pixels is carried out sequentially by each row, and the "write period" in the first half of one frame ends at the time when the writing into all the pixels is completed.

Next, during the "light-on period" being the latter half of one frame, the gate drive circuit 22 is suspended, and the light-on control line 32 turns ON simultaneously the light-on TFT switches 9 of all the pixels by way of the light-on switch OR gates 31 and the light-on switch lines 19. At this moment, the triangular pulse input line 27 inputs the triangular pulse as illustrated in FIG. 3 as the signal line data into the signal lines 17 through the triangular pulse input switches 26. As mentioned above, each pixel capacitor 2 is reset such that the OLED drive TFT 4 is turned ON or OFF according to whether the voltage of the signal line 17 is higher or lower than the analog signal voltage written in advance. Since the light-on TFT switch 9 is always ON in the "light-on period," the OLED 7 of each pixel is driven by the OLED drive TFT 4 according to the relation between the analog signal voltage written in advance and the triangular pulse voltage applied to the signal line 17. Now, if the mutual conductance (gm) (the current drive capability) of the OLED drive TFT 4 is sufficiently high, the OLED 7 can be regarded as being driven ON/OFF digitally. That is, the OLED 7 continues to light up with a virtually constant intensity only for the period that is dependent on the analog signal voltage written in advance. The modulation of this light emission period is visually recognized as a multi-gradation light emission. This recognition is not basically changed by any influences, even if the characteristic of the OLED drive TFT 4 is uneven. Now, it is preferable to make the amplitude of the triangular pulse shown in FIG. 3 substantially coincident with the amplitude of the analog signal voltage. In regard to the waveform of the triangular pulse, various changes are possible within the gist of the invention. This embodiment takes on the triangular waveform of bilateral symmetry such that the center of the emitting period does not depend upon the gradation of light emission. However, it is possible to use an asymmetrical triangular waveform, a non-linear triangular waveform equivalent to the gamma characteristic modulation, or plural triangular waveforms, etc. to attain different visual characteristics.

According to the aforementioned embodiment, it is possible to set a non-emission period of light between two consecutive frames by controlling the light-on time of a light emitting means in one frame equal to the "light-on period." This embodiment achieves a smooth animated image display. Further, according to this embodiment, the value of the analog signal voltage written in a capacitance means of each pixel controls the light-on period of the light emitting means without unevenness in different points of time, whereby the gradation display can be achieved. Thus, the irregularities between pixels of display quality can be reduced significantly.

In the foregoing embodiment, various modifications and changes are possible without departing from the spirit of the invention. For example, this embodiment employs the glass substrate as a TFT substrate; however, it can be replaced by other transparent insulating substrates, such as a quartz substrate or a transparent plastic substrate. Or, a non-transparent substrate can be used, if the OLED 7 is made to emit toward the upper side of the substrate.

With regard to the TFT switches, this embodiment takes on simply structured single channel analog switches; however, these analog switches can be made up with a CMOS configuration. In the description of this embodiment, the number of pixels, the panel size, and so forth are not described specifically because that the invention will not be restricted by their specifications or formats. In this embodiment, the display signal voltage is assumed as the analog voltage which may be replaced by a discrete gradation voltage, for example, of 64 gradations (6 bits). The number of signal voltage gradations is not limited to a specific value. Further, the triangular waveform can be made into a discrete form confirming with the signal voltage gradations. Also, the common terminal voltage of the OLED 7 is assumed as the ground voltage; however, this voltage can naturally be varied under a specific condition.

Further, the peripheral drive circuits composed of the gate drive circuit 22, the signal drive circuit 21, and so forth are made up with the low temperature polycrystalline silicon TFT circuits. However, these peripheral drive circuits or part of them can be formed and packaged with single crystal LSI circuits.

In this embodiment, the OLED 7 is adapted as the light emitting means. However, in replacement of this, a general light emitting means including the other inorganic diodes or illuminants can implement the present invention.

Further, in case of providing the OLED 7 respectively for each color of red, green, and blue for colorization, it is preferable to vary the conditions of the area in conjunction with the drive voltage of the OLED 7 in order to attain the color balance. Here, in case of varying the drive voltage, it is possible in this embodiment to vary and adjust the applied voltage of the power supply line 18 for each color. In this case, it is preferable to array the three colors in stripes to simplify the wiring. Although this embodiment takes the ground voltage as the common terminal voltage of the OLED 7, it is also possible to separate the terminal of the OLED 7 for each color of red, green, and blue, and to drive each by an appropriate voltage. Further, adjusting the drive voltage appropriately by the display conditions or the display patterns will also correct the color temperature.

Further, the ratio of the "write period" and the "light-on period" is set to 50% each; however, this ratio can be varied in accordance with the conditions. For example, if the "light-on period" is shortened, the movement of animated images becomes smooth, but the screen is apt to become dark to the same degree. From consideration of these factors, the "light-on period" can appropriately be set to 70%, 30%, 10% of a frame period.

The various modifications and changes mentioned above can be applied to the other embodiments, which will be described hereunder.

Second Embodiment

The second embodiment of the invention is described with reference to FIG. 4 and FIGS. 5(*a*) and 5(*b*).

Figure 4:
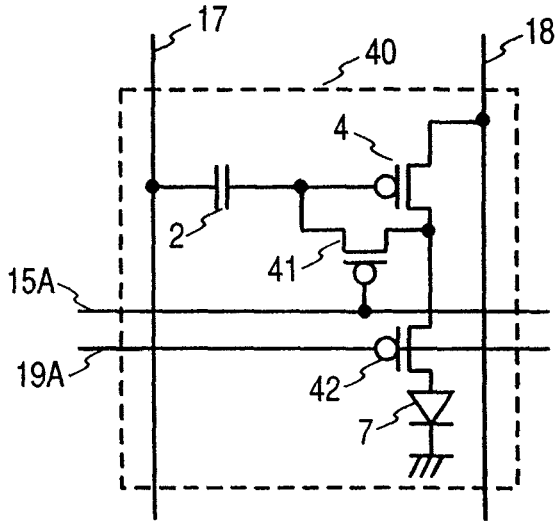
FIG. 4 shows a pixel configuration in the second embodiment of the present invention.

FIG. 4 illustrates the configuration of a pixel 40 in the second embodiment.

The whole construction and the operation of this embodiment are basically the same as those of the first embodiment, except for a reset TFT switch 41 and a light-on TFT switch 42 being composed of p-channel MOS transistors. Accordingly, the description of the whole construction and the operation is omitted, and the reset TFT switch 41 and light-on TFT switch 42, the distinctive features of this embodiment, is explained hereunder.

Figure 5A:
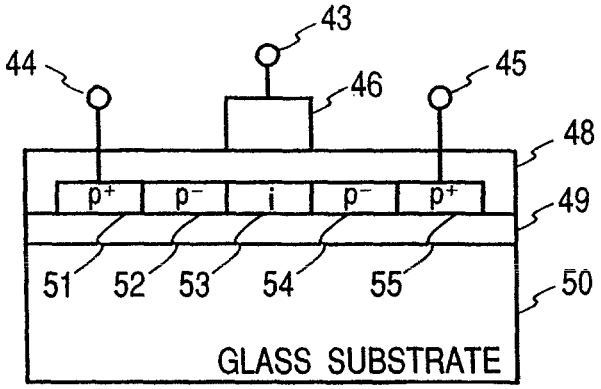
FIGS. 5(*a*) and 5(*b*) illustrate the cross-sectional structures of the switches of the second embodiment.
Figure 5B:
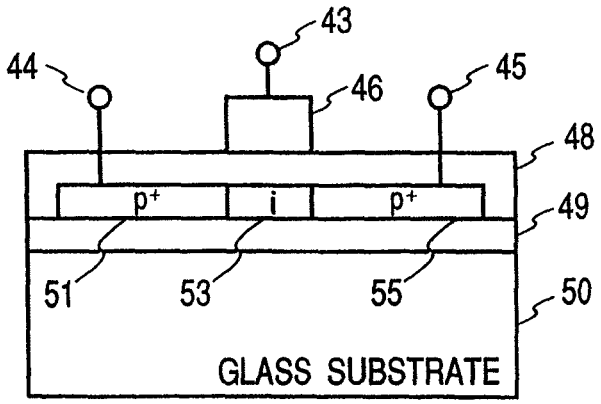

FIG. 5(*a*) illustrates the cross-sectional structure of the reset TFT switch 41, and FIG. 5(*b*) illustrates the cross-sectional structure of the OLED drive TFT 4 and the light-on TFT switch 42. As described in the first embodiment, both the TFTs are formed by means of the low temperature polycrystalline silicon TFT process. First, on a glass substrate 50 an i (impurity non-introduction)-type polycrystalline silicon thin film 53 is formed through a buffer film 49. On the i-type poly-Si thin film 53, p+(high concentration p-type) regions 51 and 55 that serve as the drain and source electrodes are formed. And, a gate electrode 46 is formed on a gate insulating film 48 that overlies the film 53. Further, the gate electrode 46, the drain electrode 51, and the source electrode 55 each have terminal 43, 44, 45 connected. Here, the difference between the reset TFT switch 41 shown in FIG. 5(*a*) and the light-on TFT switch 42 shown in FIG. 5(*b*) lies in that the former adapts the so-called LDD (lightly Doped Drain) transistor structure having p-(low concentration p-type) regions 52, 54 formed on the poly-Si thin film 53 near the gate. Since it is required to hold the charge corresponding to a signal stored in the pixel capacitor 2, the OFF-current of the reset TFT switch 41 has to be sufficiently low. On the other hand, the OLED drive TFT 4 has to have a high mutual conductance (gm) to attain a sharp ON/OFF operation of the OLED 7, and the light-on TFT switch 42 has to make the irregularity of the voltage drop invisible, which results from the OLED 7 drive current and the parasitic resistance. Therefore, the light-on TFT switch 42 does not adapt the LDD transistor structure. The LDD transistor has the advantage of achieving a still lower leak current during OFF; however, it has a higher parasitic resistance during ON, which means that it has a trade-off to equivalently lower the mutual conductance (gm).

In this embodiment, since the pixel 40 is composed of only the p-channel MOS transistors, the layout of the pixel unit is simplified so as to achieve a high definition and high yield. Further, if all the TFTs constituting the pixel peripheral circuits are made up with the p-channel MOS transistors by using, for example, LSI mounting circuits, the process is simplified (by excluding n-channel MOS transistors) thereby reducing production cost.

In this embodiment, the reset TFT switch 41 and the light-on TFT switch 42 use the p-channel MOS transistors, and the positive and negative directions of the drive waveforms of both switches are reverse to those in the first embodiment.

Third Embodiment

The third embodiment of the invention is described with reference to FIG. 6.

Figure 6:
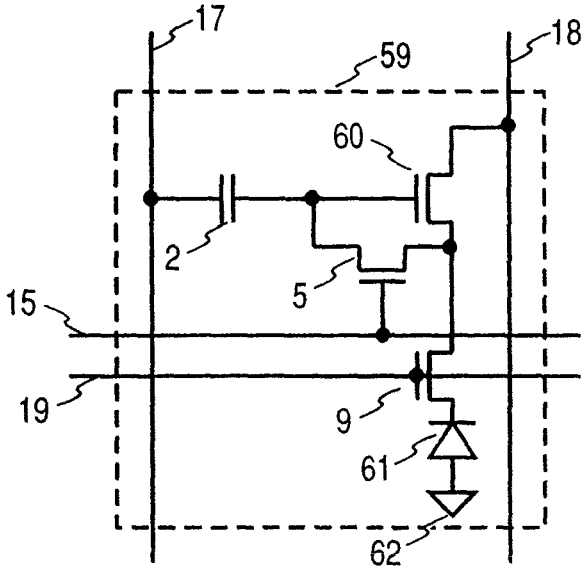
FIG. 6 shows a pixel configuration in the third embodiment of the present invention.

FIG. 6 illustrates the configuration of a pixel 59 in the third embodiment.

The whole construction and the operation of this embodiment are basically the same as those of the first embodiment, except for an OLED drive TFT 60 being composed of an n-channel MOS transistor, and the cathode and anode of an OLED 61 being connected in reverse. Accordingly, the description of the common construction and the operation is omitted. The OLED drive TFT 60, the OLED 61, and the distinctive features of this embodiment are explained hereunder.

To an electrode 62 opposite to the OLED 61 is applied with a higher voltage than that of the power supply line 18, and the source of the OLED drive TFT 60 is connected to the power supply line 18 (the same circuit connection as that of the first embodiment). However, since the OLED drive TFT 60 is the n-channel MOS transistor, the upper/lower relation of the analog signal voltage and the triangular pulse become reversed. That is, when the voltage of the triangular pulse is higher than the analog signal voltage written in advance, the OLED drive TFT 60 is turned ON, and when the voltage of the triangular pulse is lower than the analog signal voltage written in advance, the OLED drive TFT 60 is turned OFF. Therefore, the white/black relation of the analog signal voltage is reversed, and the others are the same as the first embodiment.

In this embodiment, since the pixel 59 is composed of only the n-channel MOS transistors, the layout of the pixel unit is simplified to achieve a high definition and high yield. Further, if all the TFTs constituting the pixel peripheral circuits are made up with the n-channel MOS transistors by using, for example, LSI mounting circuits, the process is simplified by excluding p-channel MOS transistors thereby reducing production cost.

Fourth Embodiment

The fourth embodiment of the invention is described with reference to FIG. 7.

Figure 7:
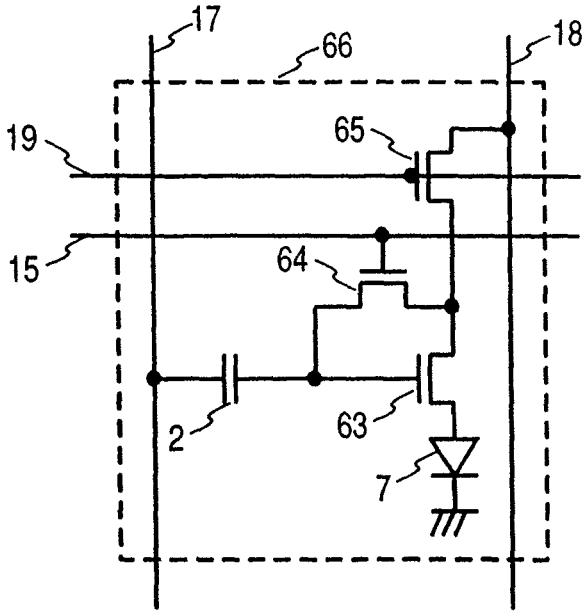
FIG. 7 shows a pixel configuration in the fourth embodiment of the present invention.

FIG. 7 illustrates the configuration of a pixel 66 in the fourth embodiment.

The whole construction and the operation of this embodiment are basically the same as those of the first embodiment, except for an OLED drive TFT 63 being composed of an n-channel MOS transistor. And accompanied with this, the locations of a reset TFT switch 64 and a light-on TFT switch 65 being changed. Accordingly, the description of the common construction and the operation is omitted. The OLED drive TFT 63, the reset TFT switch 64, the light-on TFT switch 65, and the distinctive features of this embodiment are explained hereunder.

Since the OLED drive TFT 63 is the n-channel MOS transistor, the electrode connected to the OLED 7 is the source. Accordingly, the light-on TFT switch 65 is placed between the power supply line 18 and the OLED drive TFT 63. The reset TFT switch 64 is connected across the drain and the gate of the OLED drive TFT 63, which is opposite to the OLED 7 as shown in FIG. 7. In this embodiment, the construction of the pixel is changed but the basic operation is the same as the third embodiment, and also the merits are the same as the third embodiment. However, since the OLED 7 acts as the source resistor of the OLED drive TFT 63 in this embodiment, the characteristic irregularities of the OLED drive TFT 63 are apt to become visible, as compared with the other embodiments.

Fifth Embodiment

The fifth embodiment of the invention is described with reference to FIG. 8 and FIG. 9.

Figure 8:
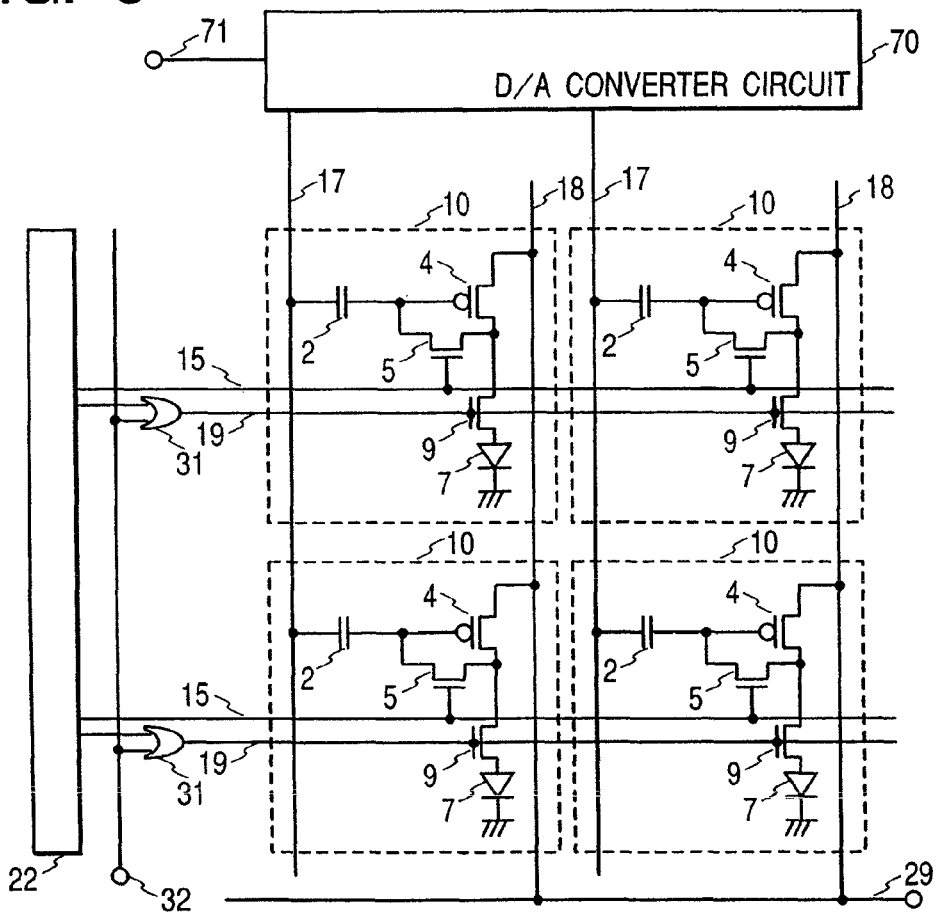
FIG. 8 is a structure configuration of an OLED display panel in the fifth embodiment of the present invention.

FIG. 8 illustrates a configuration of an OLED (Organic Light Emitting Diode) display panel in this embodiment. The construction and the operation of this embodiment are basically the same as those of the first embodiment, except for the signal input switch 23, the signal drive circuit 21, the triangular pulse input switch 26, and the triangular pulse input line 27 being removed from the upper and lower parts of the signal line 17, and a 6-bit DA converter circuit 70 having a digital signal input line 71 being provided in replacement of these. Accordingly, the description of the common construction and the operation is omitted. The DA converter circuit 70 and the distinctive features of this embodiment are explained hereunder.

Figure 9:
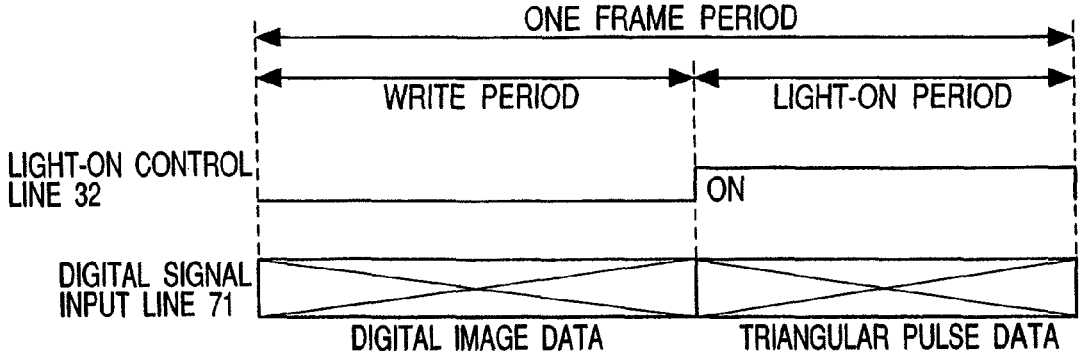
FIG. 9 shows the waveforms of the light-on control line and a digital signal input line in the fifth embodiment.

FIG. 9 illustrates the operation waveform of the light-on control line 32 and the digital signal input line 71 in one frame period in this embodiment. The one frame period is predetermined as 1/60 second in this embodiment, which is divided into the "write period" in the first half and the "light-on period" in the latter half. The light-on control line 32 is turned OFF during the "write period," but it is turned ON during the "light-on period." Thereby, the light-on control line 32 fixes the light-on TFT switches 9 of all the pixels into the ON state simultaneously through the light-on switch lines 19. And, to the digital signal input line 71, digital image data is inputted during the "write period," and triangular pulse data is inputted during the "light-on period." Thereby, the analog signal voltage is outputted during the "write period," and the triangular pulse voltage is outputted during the "light-on period" to the signal line 17 through the DA converter circuit 70. That is, in this embodiment, the employment of the DA converter circuit 70 makes the digital input possible. In addition, it makes the switching operations of the signal input switches 23 and triangular pulse input switches 26 needless. Therefore, the drive signals to the OLED display panel can be simplified.

In this embodiment, the DA converter circuit 70 is also formed integrally on a glass substrate by using the low temperature polycrystalline silicon TFTs to reduce production cost. The DA converter circuit 70 can be also implemented by mounting an LSI. In the latter case, the LSI is mounted as a component which incurs the mounting cost. However, it becomes easily to implement a higher performance 8-bit DA converter circuit.

Sixth Embodiment

The sixth embodiment of the invention is described with reference to FIG. 10 through FIG. 12.

Figure 10:
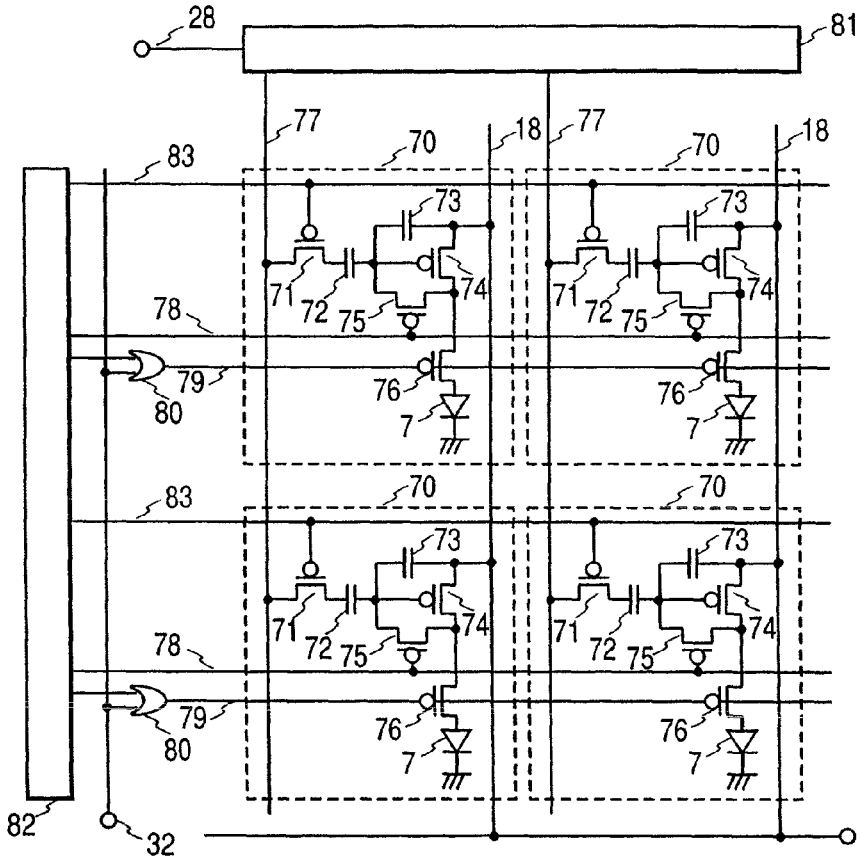
FIG. 10 is a structure configuration of an OLED display panel in the sixth embodiment of the present invention.

First, the total construction of this embodiment is discussed with FIG. 10.

FIG. 10 illustrates a configuration of an OLED (Organic Light Emitting Diode) display panel in this embodiment. Pixels 70 each having the OLED 7 as a pixel luminous object are arrayed in a matrix form on a display unit. Each pixel is connected to the drive circuits furnished surrounding the display unit through a reset line 78, a signal line 77, a light-on switch line 79, and an input switch line 83, etc. The reset line 78 and the input switch line 83 are connected to the scanning output of a gate drive circuit 82. The signal line 77 is connected to a signal drive circuit 81. To the signal drive circuit 81 is connected the signal input line 28 that inputs the analog signal voltage. Since the signal drive circuit 81 is an analog signal voltage distribution circuit configured with generally known shift registers and analog switches, its details thereof are omitted. The light-on switch line 79 is outputted from a light-on switch OR gate 80. To the light-on switch OR gate 80 are inputted the scanning output of the gate drive circuit 82 and the light-on control line 32. Since the gate drive circuit 82 is made up with generally known shift registers, its details thereof are omitted. Here, all the circuits of the pixel 70, the gate drive circuit 82, and the signal drive circuit 81, etc., illustrated in FIG. 10 are formed on a glass substrate by using the generally known low temperature polycrystalline silicon TFTs. In each pixel, the signal line 77 is connected through an input TFT switch 71 (controlled by the input switch line 83 and a pixel capacitor 72) to the gate of an OLED drive TFT 74 (a p-channel MOS transistor). The source of the OLED drive TFT 74 is connected to the power supply line 18. The drain of the OLED drive TFT 74 is connected by way of a light-on TFT switch 76 (controlled by the light-on switch line 79) to one end of the OLED 7. The other end of the OLED 7 is connected to the common ground. Further, across the gate and the drain of the OLED drive TFT 74 is furnished a reset TFT switch 75 that is controlled by the reset line 78. Across the gate and the source of the OLED drive TFT 74 is furnished a retention capacitor 73.

Figure 11:
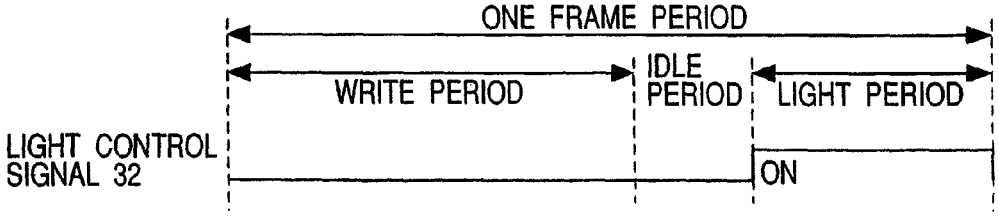
FIG. 11 shows a waveform of the light-on control line in the sixth embodiment.
Figure 12:
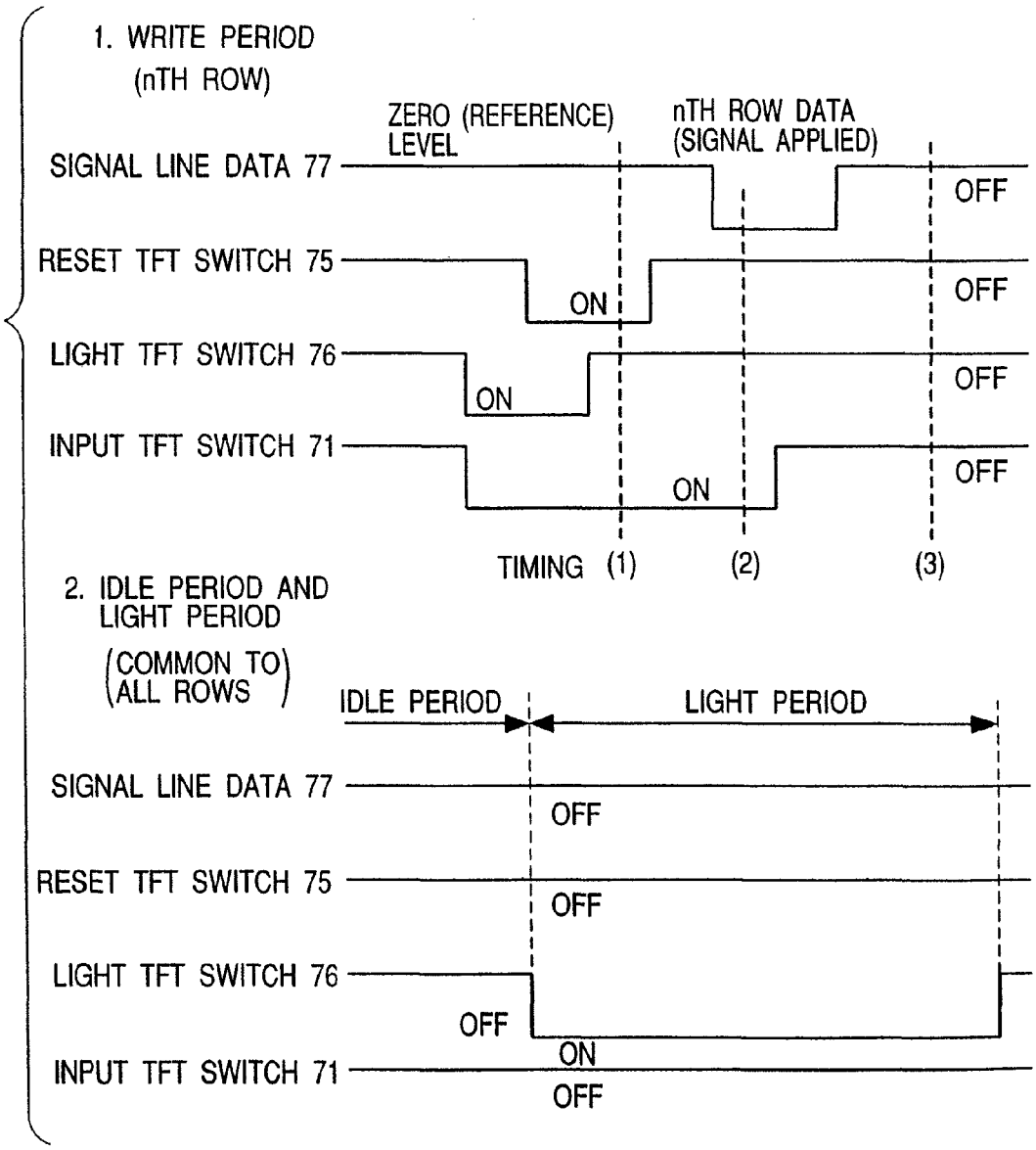
FIG. 12 shows a waveform timing chart of the drives to the switches and the inputs of the signal line data in the sixth embodiment.

Next, the operation of this embodiment is explained with FIG. 11 and FIG. 12.

FIG. 11 illustrates the operation waveform of the light-on control line 32 in one frame period in this embodiment. The one frame period is predetermined as 1/60 second in this embodiment, which is divided into a "write period" in the first half, as well as an "idle period" and a "light-on period" in the latter half. The light-on control line 32 is turned OFF during the "write period" and the "idle period," but turned ON during the "light-on period." Thereby, the light-on control line 32 fixes the light-on TFT switches 76 of all the pixels into the ON state simultaneously through the light-on switch lines 79. Further, during the "write period," the gate drive circuit 82 scans the reset line 78, the light-on switch line 79, and the input switch line 83 The analog signal voltage is sequentially inputted to the signal line 77. During the "idle period" and the "light-on period," the gate drive circuit 82 is put into pause, and the signal input to the signal line 77 is put into pause.

FIG. 12 illustrates the waveform timing of the reset TFT switch 75, of the light-on TFT switch 76, of the input TFT switch 71, and of the data input on the signal line 77 in each pixel according to the "write period", and as well as the "idle period", and the "light-on period."

During the "write period" (being the first half of one frame), the gate drive circuit 82 sequentially scans each of the pixel rows. Synchronously, the signal drive circuit 81 writes the analog signal voltage into the signal lines 77 as signal data. In particular, in the pixel on the n-th row selected by the gate drive circuit 82, the light-on TFT switch 76 and the input TFT switch 71 are turned ON first, and then the reset TFT switch 75 is turned ON. As these switches are turned ON, the OLED drive TFT 74 is put into a diode connection with the same potential applied across the gate and the drain thereof. Accordingly, applying a specific voltage to the power supply line 18 in advance will put the OLED drive TFT 74 and the OLED 7 into the conductive state. Next, as the light-on TFT switch 76 is turned OFF (timing (1)), the OLED drive TFT 74 and the OLED 7 are forcibly put into the OFF state. At this moment, since the gate and the drain of the OLED drive TFT 74 are short-circuited through the reset TFT switch 75, the gate voltage of the OLED drive TFT 74 (whose gate is connected to one end of the pixel capacitor 72) is automatically reset to a voltage lower by the threshold voltage Vth than the voltage of the power supply line 18. At this moment, the analog signal voltage of zero (reference) level is inputted as the signal line 77 data to the other end of the pixel capacitor 72 through the input TFT switch 71.

Next, as the reset TFT switch 75 is turned OFF, the potential difference between both ends of the pixel capacitor 72 is stored to remain intact in the pixel capacitor 72. Next, as the specific analog signal voltage is applied as the signal line 77 data (timing (2)), the voltage across both the ends of the pixel capacitor 72 is shifted by a voltage equivalent to a difference between the zero (reference) level analog signal voltage and the analog signal voltage. Also, to the gate of the OLED drive TFT 74 is applied the voltage shifted by the voltage equivalent to the difference from the previous reset voltage, and this voltage is held by the retention capacitor 73. Thereafter, the input TFT switch 71 is turned OFF, and the signal line 77 data is returned to the zero (reference) level (timing (3)) thereby completing the signal writing to the pixels on the n-th row. Thereafter, during the period of scanning the pixels on the other rows, the light-on TFT switch 76 of the concerned pixel is always OFF. Accordingly, the OLED 7 will not light up regardless of a level of the analog signal voltage written into the gate of the OLED drive TFT 74. In this manner, the writing of the analog signal voltage into the pixels is carried out sequentially by each row. The "write period" in the first half of a frame ends at the time when the write into all the pixels is completed.

Next, the gate drive circuit 82 is put into pause in the latter half of a frame. During the "idle period," all the switches shown in FIG. 12 are turned OFF, and the states of the pixels are not changed. During the subsequent "light-on period," the light-on control line 32 turns ON simultaneously the light-on TFT switches 76 of all the pixels by way of the light-on switch OR gates 80 and the light-on switch lines 79. Here, as mentioned above, since the voltage corresponding to the analog signal voltage written into each pixel is applied to the gate of the OLED drive TFT 74, a signal current corresponding to this voltage flows through the OLED 7 of each pixel to perform a gradation emission. As such, the unevenness of the threshold voltage Vth of the gate of the OLED drive TFT 74 is cancelled.

According to the aforementioned embodiment, it is possible to set a non-emission period of light between two consecutive frames by controlling the light-on time of a light emitting means in one frame equal to the "light-on period." This embodiment achieves a smooth animated image display. And, since the "idle period" is newly provided, it becomes possible to easily vary the "light-on period" with the clock frequency of the gate drive circuit 82 maintained to a constant. In this embodiment, only an adjustment of the timing signal of the light-on control line 32 will easily vary the visual characteristic and the visual display intensity of animated images.

Seventh Embodiment

The seventh embodiment of the invention is described with reference to FIG. 13 and FIG. 14.

Figure 13:
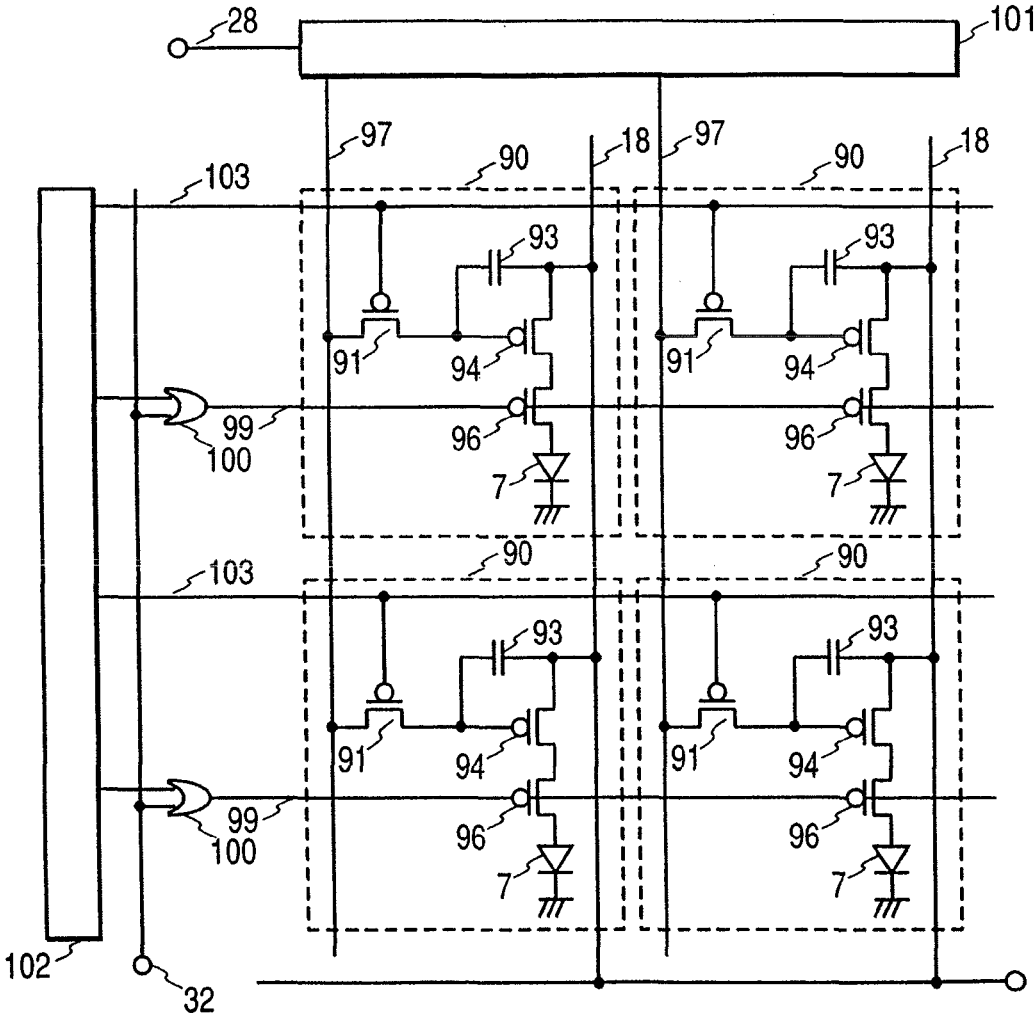
FIG. 13 is a structure configuration of an OLED display panel in the seventh embodiment of the present invention.

First, the total construction of this embodiment is discussed with FIG. 13.

FIG. 13 illustrates a configuration of an OLED (Organic Light Emitting Diode) display panel in this embodiment. Pixels 90 each having the OLED 7 as a pixel luminous object are arrayed in a matrix form on a display unit. Each pixel is connected to the drive circuits furnished surrounding the display unit through a signal line 97, a light-on switch line 99, and an input switch line 103, etc. The input switch line 103 is connected to the scanning output of a gate drive circuit 102. The signal line 97 is connected to a signal drive circuit 101. To the signal drive circuit 101 is connected the signal input line 28 that inputs the analog signal voltage. Since the signal drive circuit 101 is an analog signal voltage distribution circuit configured with generally known shift registers and analog switches, its details thereof are omitted here. The light-on switch line 99 is outputted from a light-on switch OR gate 100. To the light-on switch OR gate 100 are inputted the scanning output of the gate drive circuit 102 and the light-on control line 32. Since the gate drive circuit 102 is made up with generally known shift registers, its details thereof are omitted. Here, all the circuits of the pixel the gate drive circuit 102, and the signal drive circuit 101, etc., illustrated in FIG. 13 are formed on a glass substrate by using the generally known low temperature polycrystalline silicon TFTs. In each pixel, the signal line 97 is connected through an input TFT switch 91 controlled by the input switch line 103 to the gate of an OLED drive TFT 94 (a p-channel MOS transistor). The source of the OLED drive TFT 94 is connected to the power supply line 18. The drain of the OLED drive TFT 94 is connected by way of a light-on TFT switch 96 controlled by the light-on switch line 99 to one end of the OLED 7. The other end of the OLED 7 is connected to the common ground. Further, across the gate and source of the OLED drive TFT 94 is furnished a retention capacitor 93.

Figure 14:
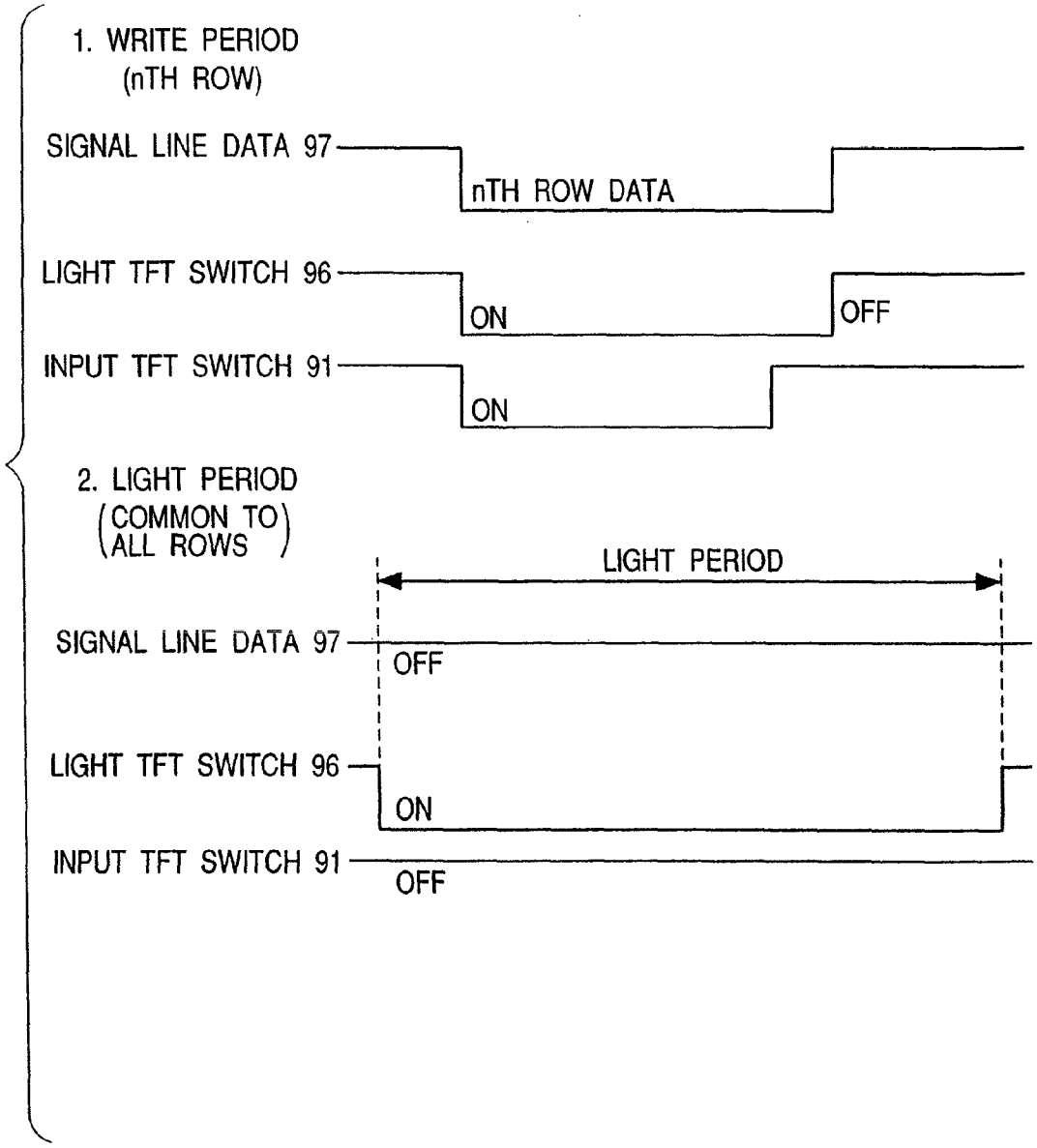
FIG. 14 shows a waveform timing chart of the drives to the switches and the inputs of the signal line data in the seventh embodiment.

Next, the operation of this embodiment is explained with FIG. 14.

FIG. 14 illustrates the waveform timing of the light-on TFT switch 96, of the input TFT switch 91, and of the data input on the signal line 97 in each pixel according to the "write period" and the "light-on period."

During the "write period" (being the first half of one frame), the gate drive circuit 102 sequentially scans each of the pixel rows. Synchronously, the signal drive circuit 101 writes the analog signal voltage into the signal lines 97 as a signal data. In particular, in the pixel on the n-th row selected by the gate drive circuit 102, the light-on TFT switch 96 and the input TFT switch 91 are turned ON, and the analog signal voltage is applied to the pixel as the signal line 97 data. Here, applying a specific voltage to the power supply line 18 in advance will put the OLED drive TFT 94 and the OLED 7 into the conductive state, and the OLED 7 will emit with a brightness corresponding to the analog signal voltage. Next, as the input TFT switch 91 is turned OFF, the analog signal voltage at this moment is stored in the retention capacitor 93, and then the light-on TFT switch 96 is turned OFF, which immediately stops the emission of the OLED 7. Thereafter, during the period of scanning the pixels of the other rows, the light-on TFT switch 96 of the concerned pixel is always OFF. Accordingly, the OLED 7 will not light up regardless of a level of the analog signal voltage written into the gate of the OLED drive TFT 94. In this manner, the writing of the analog signal voltage into the pixels is carried out sequentially by each row, and the "write period" in the first half of one frame ends at the time when the writing into all the pixels is completed.

Next, the gate drive circuit 102 is put into pause in the "light-on period" (in the latter half of one frame), and the light-on control line 32 turns ON simultaneously the light-on TFT switches 96 of all the pixels by way of the light-on switch OR gates 100 and the light-on switch lines 99. Here, as mentioned above, since the analog signal voltage written into each pixel is stored in the gate of the OLED drive TFT 94, a signal current corresponding to this voltage flows through the OLED 7 of each pixel to perform a gradation emission.

According to the aforementioned embodiment, it is possible to set a non-emission period of light between two consecutive frames by controlling the light-on time of a light emitting means in one frame equal to the "light-on period." This embodiment achieves a smooth animated image display.

Eighth Embodiment

The sixth embodiment of the invention is described with reference to FIG. 15 and FIG. 16.

Figure 15:
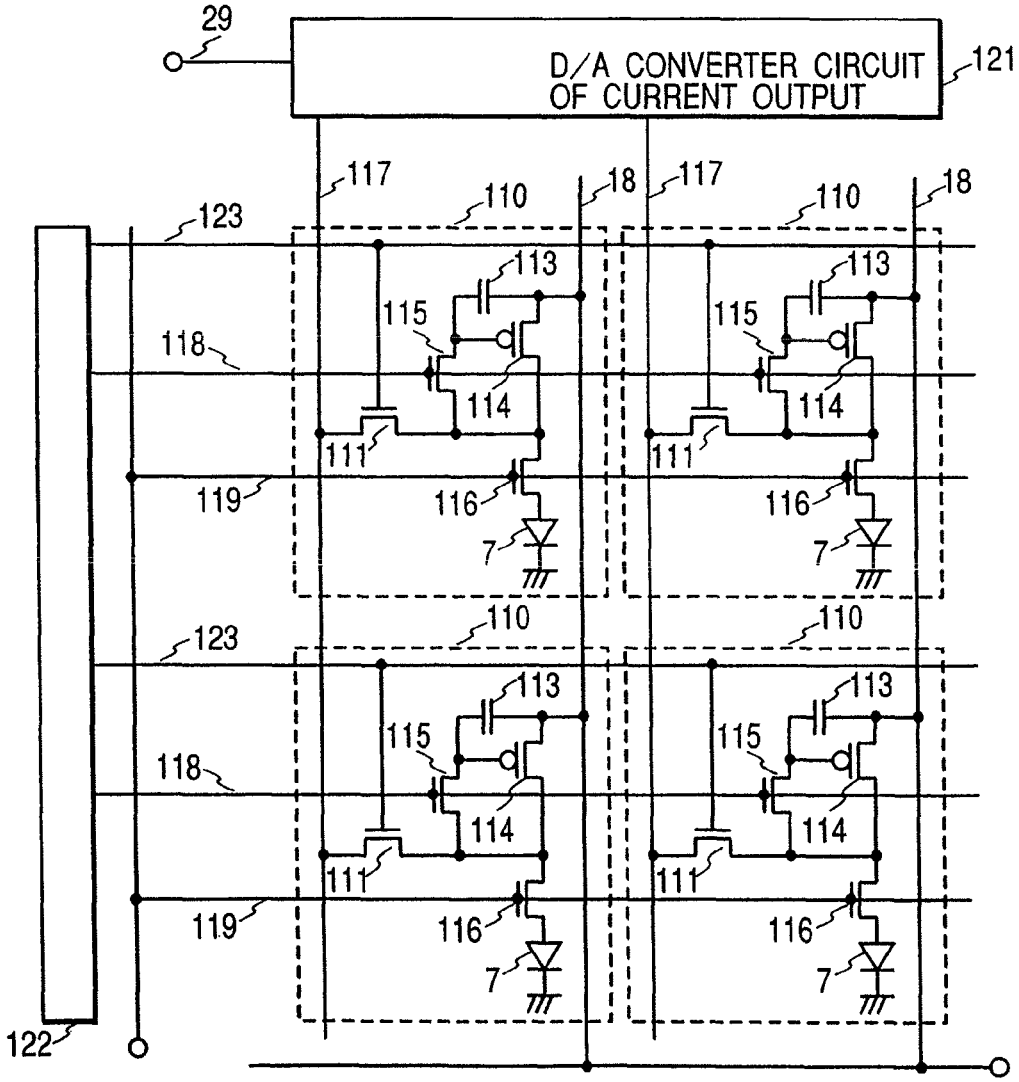
FIG. 15 is a structure configuration chart of an OLED display panel in the eighth embodiment of the present invention.

First, the total construction of this embodiment is discussed with FIG. 15.

FIG. 15 illustrates a configuration of an OLED (Organic Light Emitting Diode) display panel in this embodiment. Pixels 110 each having the OLED 7 as a pixel luminous object are arrayed in a matrix form on a display unit. Each pixel is connected to the drive circuits furnished surrounding the display unit through a reset line 118, a signal line 117, a light-on switch line 119, and an input switch line 123, etc. The reset line 118 and the input switch line 123 are connected to the scanning output of a gate drive circuit 122. The signal line 117 is connected to a current output DA converter circuit 121. To the current output DA converter circuit 121 is connected a digital signal input line 29 that inputs a digital signal. Here, the current output DA converter circuit 121 has the same configuration as the general voltage output DA converter circuit, except for the output being a gradation current. The light-on switch line 119 is connected commonly to all the pixels. Since the gate drive circuit 122 is made up with generally known shift registers, its details thereof are omitted. Here, all the circuits of the pixel 110, the gate drive circuit 122, and the current output DA converter circuit 121, etc., illustrated in FIG. 15 are formed on a glass substrate by using the generally known low temperature polycrystalline silicon TFTs. In each pixel, the signal line 117 is connected through an input TFT switch 111 (controlled by the input switch line 123) to the drain of an OLED drive TFT 114 (being a p-channel MOS transistor). The source of the OLED drive TFT 114 is connected to the power supply line 18. Further, the drain of the OLED drive TFT 114 is connected by way of a light-on TFT switch 116 (controlled by the light-on switch line 119) to one end of the OLED 7. The other end of the OLED 7 is connected to the common ground. Further, across the gate and drain of the OLED drive TFT 114 is furnished a reset TFT switch 115 controlled by the reset line 118. Across the gate and source of the OLED drive TFT 114 is furnished a retention capacitor 113.

Figure 16:
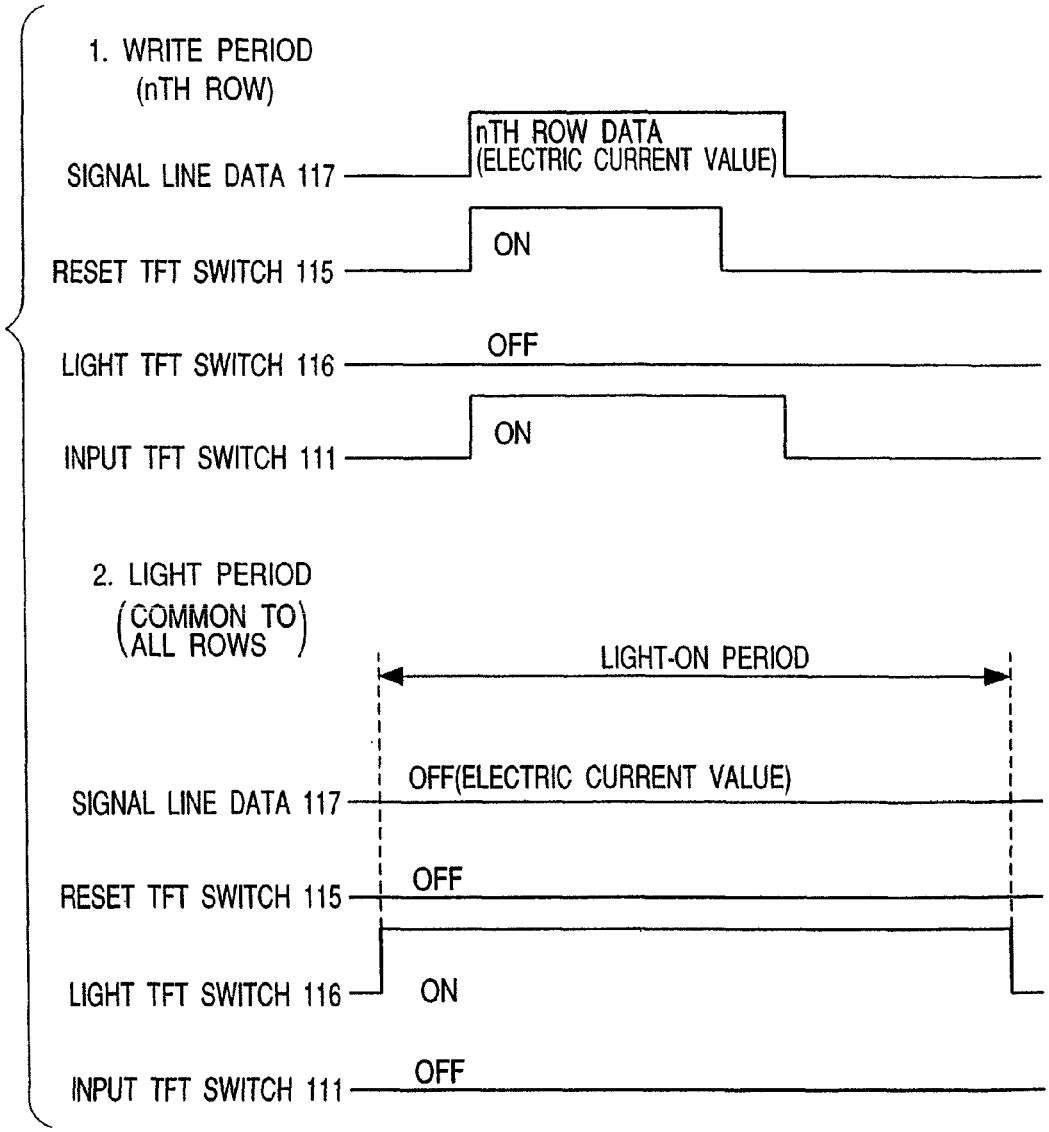
FIG. 16 shows a waveform timing chart of the drives to the switches and the inputs of the signal line data in the eighth embodiment.

Next, the operation of this embodiment is explained with FIG. 16.

FIG. 16 illustrates the waveform timing of the reset TFT switch 115, of the light-on TFT switch 116, of the input TFT switch 111, and of the data input on the signal line 117 in each pixel according to the "write period" and the "light-on period."

During the "write period" (being the first half of one frame), the gate drive circuit 122 sequentially scans each of the pixel rows. Synchronously, the current output DA converter circuit 121 writes the analog signal current into the signal lines 117 as signal data. In particular, in the pixel on the n-th row selected by the gate drive circuit 122, the input TFT switch 111 and the reset TFT switch 115 are turned ON. As these switches are turned ON, the OLED drive TFT 114 is put into a diode connection with the same potential applied across the gate and drain thereof, and the analog signal current flows toward the power supply line 18 by way of the OLED drive TFT 114. At this moment, across the source and drain of the OLED drive TFT 114 appears a gate voltage corresponding to the analog signal current. Next when the reset TFT switch 115 is turned OFF, the gate voltage corresponding to the analog signal current is stored in the retention capacitor 113. Thereafter, the analog signal current on the signal line 117 is cut off and the input TFT switch 111 is turned OFF thereby completing the signal writing to the pixels on the n-th row. Here, during the "write period," the light-on TFT switch 116 is always OFF. Accordingly, the OLED 7 will not light up regardless of a voltage level written in the retention capacitor 113, namely, the gate of the OLED drive TFT 114. In this manner, the writing of the analog signal voltage into the pixels is carried out sequentially by each row, and the "write period" in the first half of a frame ends at the time when the writing into all the pixels is completed.

Next, the gate drive circuit 122 is put into pause in the "light-on period" (in the latter half of one frame) and the light-on switch line 119 turns ON simultaneously the light-on TFT switches 116 of all the pixels. Here, as mentioned above, since, at the gate of the OLED drive TFT 114, the gate voltage corresponding to the analog signal current inputted to each pixel is held by the retention capacitor 113, a current equivalent to the analog signal current flows through the OLED 7 of each pixel to perform a gradation emission. Therefore, the characteristic irregularities of the OLED drive TFT 114 are cancelled.

According to the aforementioned embodiment, it is possible to set a non-emission period of light between two consecutive frames by controlling the light-on time of a light emitting means in one frame equal to the "light-on period." This embodiment achieves a smooth animated image display.

Ninth Embodiment

The ninth embodiment of the invention is described with reference to FIG. 17 through FIG. 19. The construction and the operation of this embodiment are basically the same as those of the sixth embodiment, except that a light-on TFT switch 131 furnished on each pixel is scanned through a light-on switch line 132 by a light-on switch AND gate 130. Accordingly, the description of the common construction and the operation is omitted. The light-on TFT switch 131 and the distinctive features of this embodiment are explained hereunder.

Figure 17:
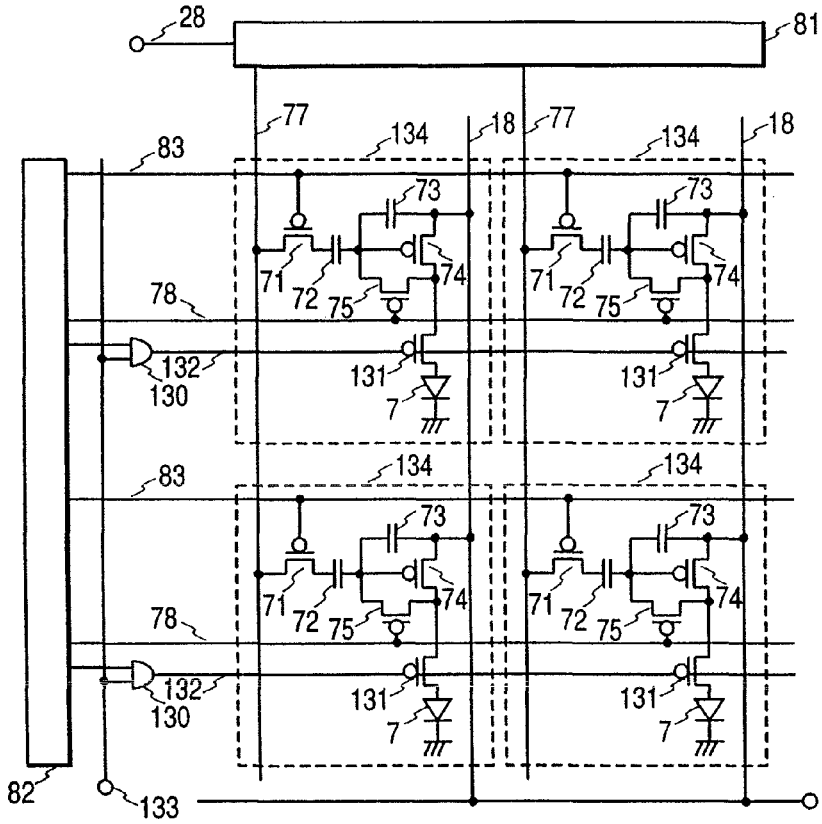
FIG. 17 is a structure configuration of an OLED display panel in the ninth embodiment of the present invention.

FIG. 17 illustrates a configuration of an OLED (Organic Light Emitting Diode) display panel in this embodiment. As mentioned above, the light-on TFT switch 131 furnished on each pixel is connected to the light-on switch AND gate 130 through the light-on switch line 132. And, the light-on switch AND gate 130 has the scanning output from the gate drive circuit 82 and a light-on control line 133 inputted.

Next, the operation of this embodiment is explained.

Figure 18:
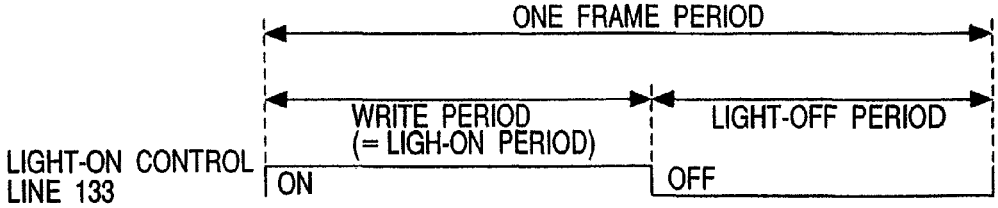
FIG. 18 shows a waveform of the light-on control line in the ninth embodiment.

FIG. 18 illustrates the operation waveform of the light-on control line 133 in one frame period in this embodiment. The light-on control line 133, being turned ON during the "write period" in the first half, lights up the OLED 7 of a specific pixel. Being turned OFF during the "light-off period" in the latter half, it turns OFF the light-on TFT switch 131 of each pixel thereby forcibly lighting OFF all the pixels of the OLED 7.

Figure 19:
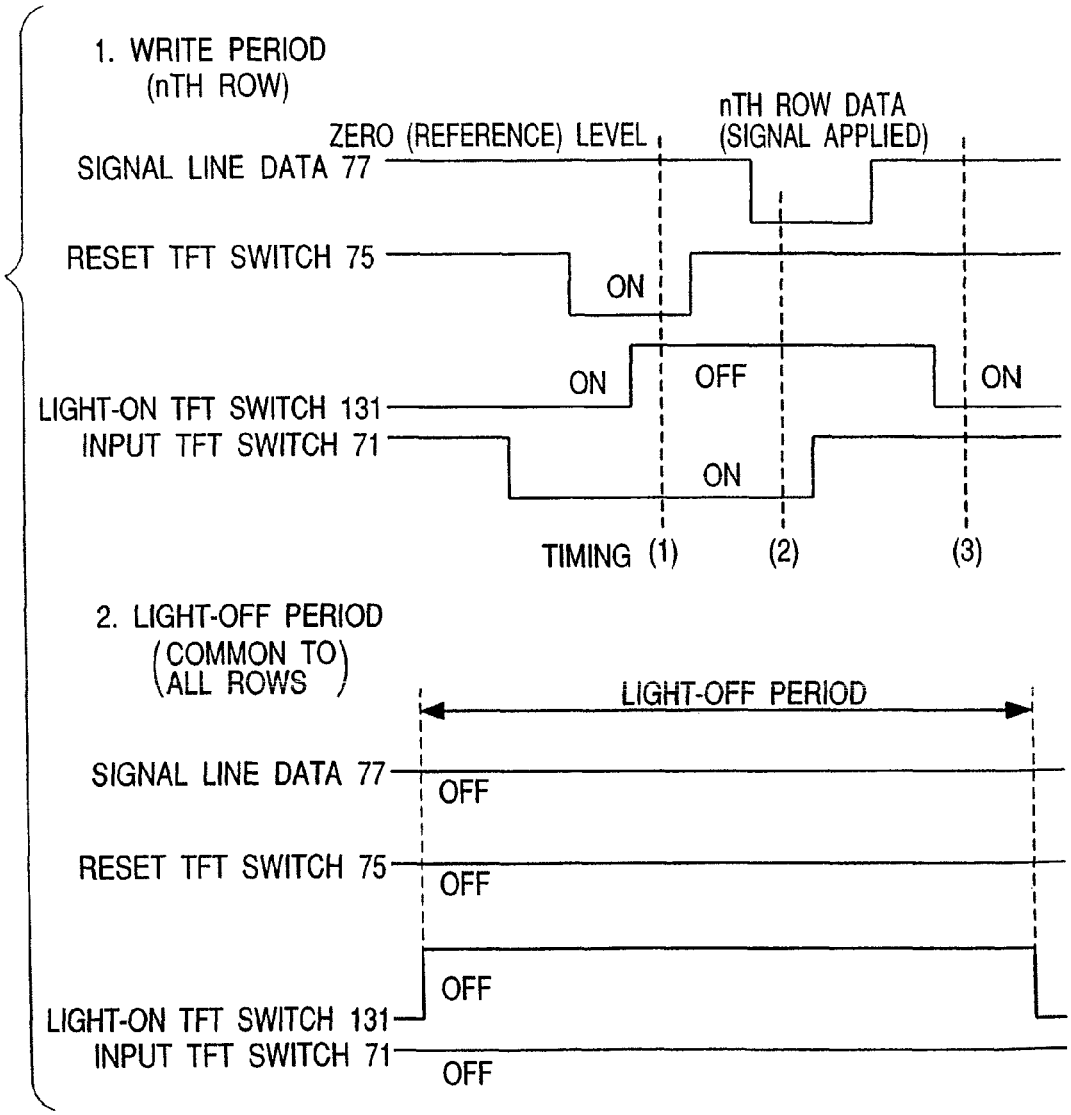
FIG. 19 shows a waveform timing chart of the drives to the switches and the inputs of the signal line data in the ninth embodiment.

FIG. 19 illustrates the waveform timing of the reset TFT switch 75, of the light-on TFT switch 131, of the input TFT switch 71, and of the data input on the signal line 77 in each pixel according to the "write period" and the "light-off period." The basic operation is the same as the foregoing sixth embodiment; however, it differs in that the light-on TFT switch 131 is always ON while the concerned row in the write period is not selected, and that the light-on TFT switch 131 is always OFF during the light-off period. Thereby in this embodiment, it is possible to set a non-emission period of light between two consecutive frames by setting the "light-on period" equal to the lighting of a light emitting means in one frame. This embodiment achieves a smooth animated image display.

Tenth Embodiment

The tenth embodiment of the invention is described with reference to FIG. 20 and FIG. 21. The construction and the operation of this embodiment are basically the same as those of the sixth embodiment, except that a light-on TFT switch 141 furnished on each pixel is scanned through a light-on switch line 142 by a light-on switch drive circuit 144. Accordingly, the description of the common construction and the operation is omitted. The light-on TFT switch 141 and the distinctive features of this embodiment are explained hereunder.

Figure 20:
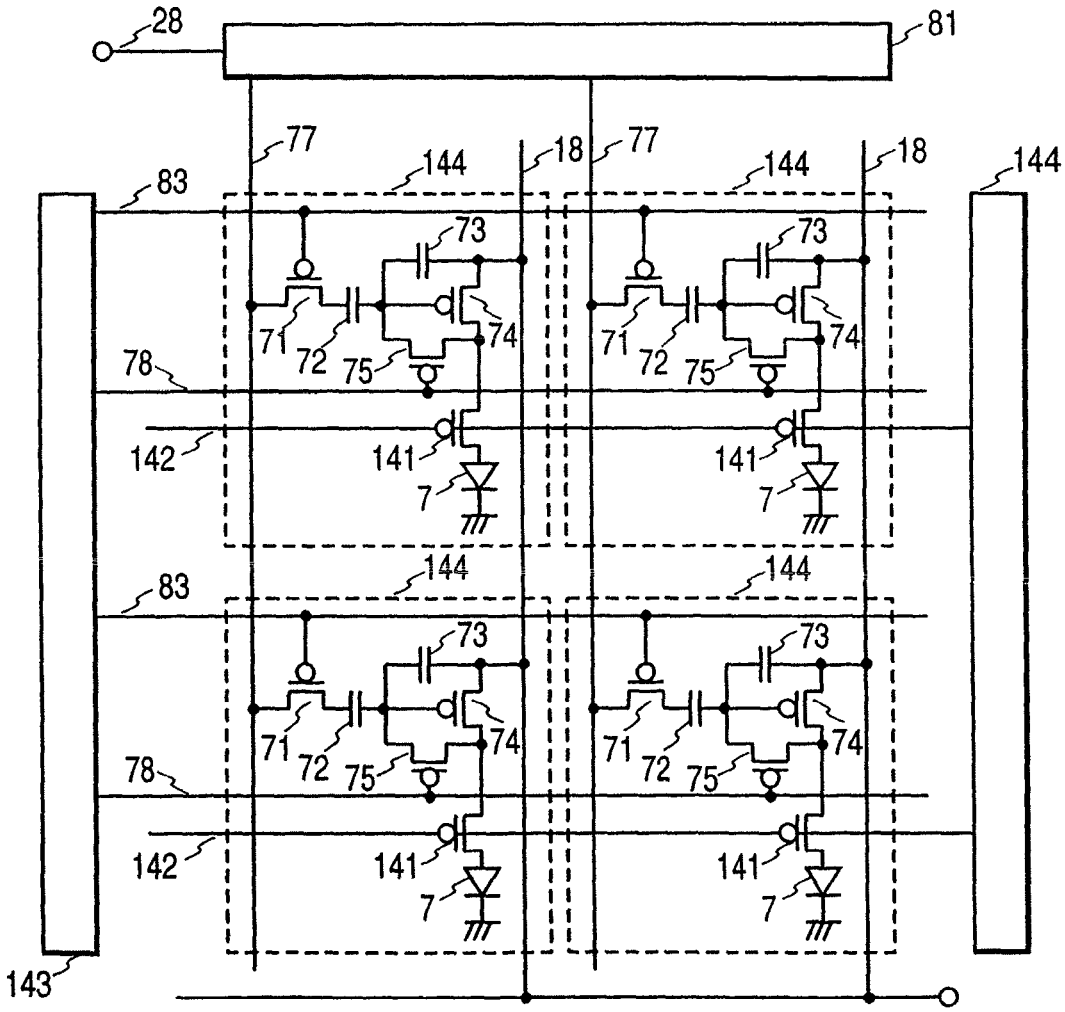
FIG. 20 is a structure configuration of an OLED display panel in the tenth embodiment of the present invention.

FIG. 20 illustrates a configuration of an OLED (Organic Light Emitting Diode) display panel in this embodiment. As mentioned above, the light-on TFT switch 141 furnished on each pixel is connected to the light-on switch drive circuit 144 through the light-on switch line 142. And, the gate drive circuit 143 is connected only to the reset line 78 and the input switch line 83.

Next, the operation of this embodiment is explained.

Figure 21:
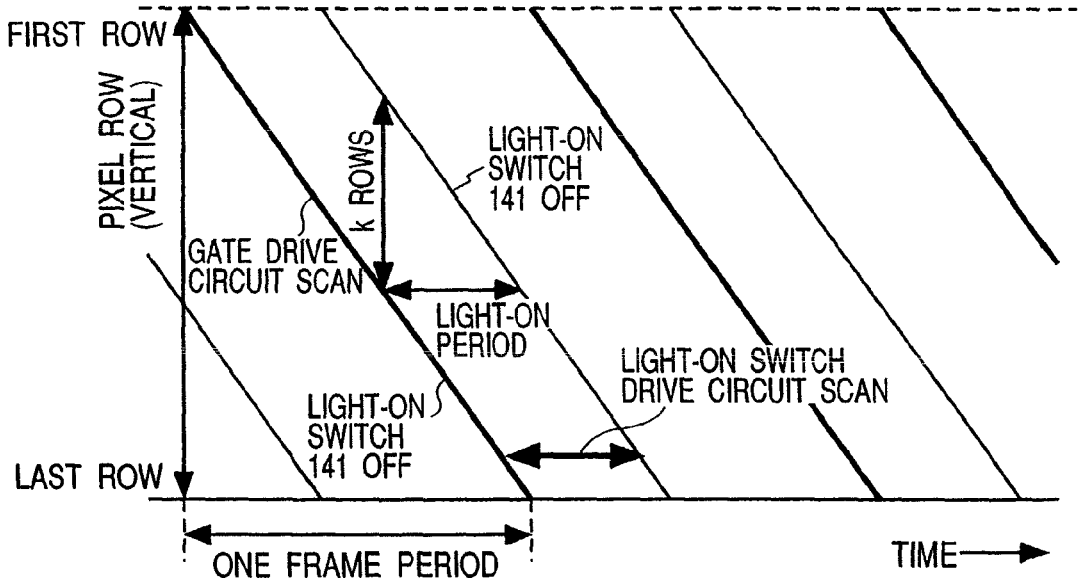
FIG. 21 is a typical scanning pattern of the gate drive circuit and the light-on switch drive circuit in the tenth embodiment.

FIG. 21 typically illustrates the scanning pattern of the gate drive circuit 143 and the light-on switch drive circuit 144 on each pixel row. In the same manner as the sixth embodiment, the gate drive circuit 143 sequentially scans and drives the reset TFT switch 75 and the input TFT switch 71. The light-on switch drive circuit 144 sequentially scans and drives the light-on TFT switch 141 from the first row to the last row of the pixels.

Now, the gate drive circuit 143 performs the scanning by each row of the pixels. One frame period includes the scanning time from the first row until the completing the last row. On the other hand, the light-on switch drive circuit 144 scans the light-on TFT switch 141 to temporarily turn ON and OFF with a delay of time for scanning k rows. Thus, the time required for the scanning of k rows is defined as the light-on period.

Thus in this embodiment, it is possible to set a non-emission period of light between two consecutive frames by setting the "light-on period" for each pixel equal to the lighting period of a light emitting means in one frame. This embodiment achieves a smooth animated image display.

Eleventh Embodiment

Figure 22:
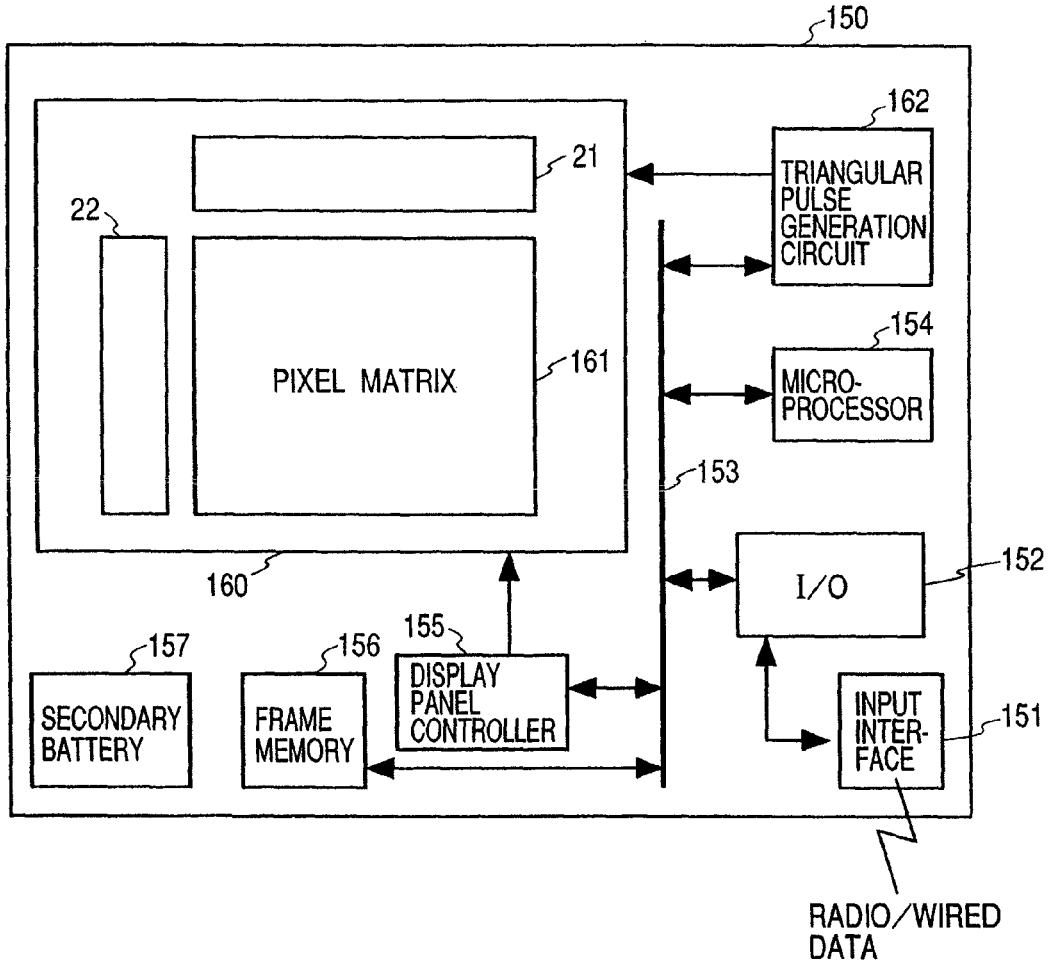
FIG. 22 is a structure configuration of an animation display system in the eleventh embodiment of the present invention.
Figure 23:
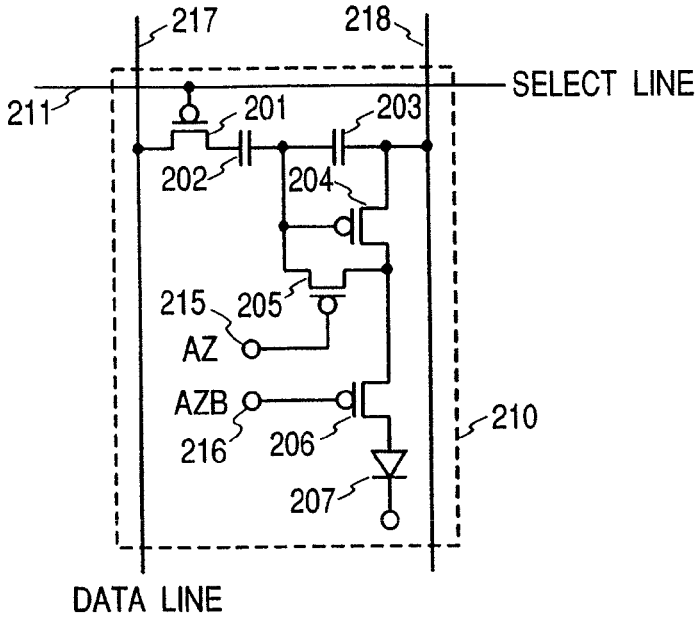
FIG. 23 PRIOR ART
FIG. 23 shows a pixel configuration of a light emitting display device using a conventional technique.
Figure 24:
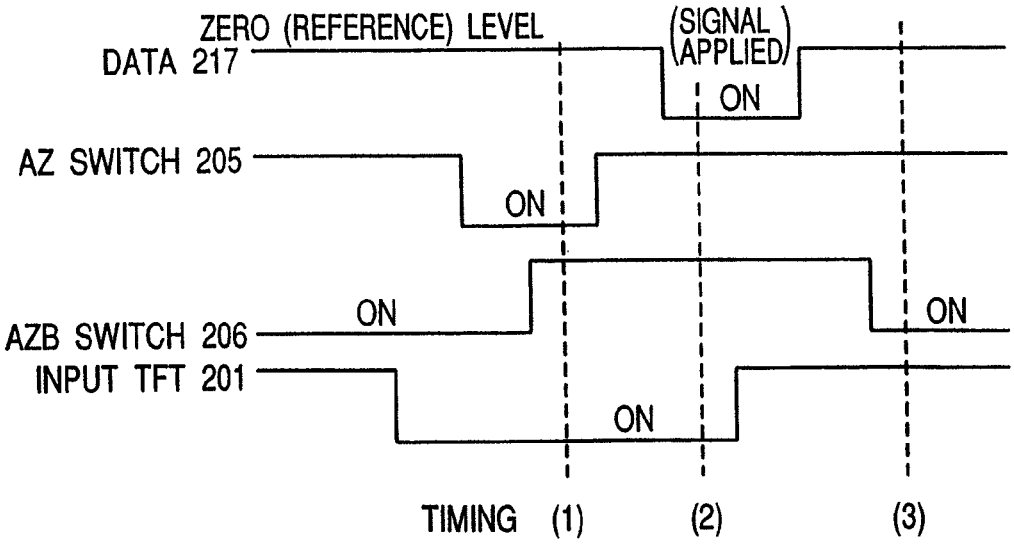
FIG. 24 PRIOR ART
FIG. 24 shows a waveform timing chart of the light emitting display device using the conventional technique.

The eleventh embodiment of the invention is described with reference to FIG. 22. FIG. 22 illustrates a configuration of an animation display device (digital television) 150 of this embodiment.

A radio or wired input interface circuit 151 receives a compressed image data, etc., as an animated data based on the MPEG standard from the outside. The output of the input interface circuit 151 is connected to a data bus 153 through an I/O (Input/Output) circuit 152. Besides, the data bus 153 is connected to a microprocessor 154 that decodes the MPEG signal, to a display panel controller 155 that incorporates a DA converter, and to a frame memory, etc. Further, the output of the display panel controller 155 enters into an OLED display panel 160, which includes a pixel matrix 161, the gate drive circuit 22, and the signal drive circuit 21, and so forth. Further, the animation display device 150 includes a triangular pulse generation circuit 162 and a secondary battery 157. The output of the triangular pulse generation circuit 162 also enters into the OLED display panel 160. Here, the OLED display panel 160 possesses the same construction and function as those of the aforementioned first embodiment such that the description of the internal construction and operation thereof is omitted.

The operation of the eleventh embodiment will be explained. First, the input interface circuit 151 fetches compressed image data from the outside according to an instruction, and transfers the image data to the microprocessor 154 and the frame memory 156 through the I/O circuit 152. Receiving instructions from a user, the microprocessor 154 drives the whole animation display device 150 as required, decodes the compressed image data, processes signals, and displays information. The image data having the signal processing applied are stored temporarily in the frame memory 156 as needed.

When the microprocessor 154 issues a display instruction, the frame memory 156 sends image data to the OLED display panel 160 through the display panel controller 155, and the pixel matrix 161 displays the inputted image data in real time. At the same time, the display panel controller 155 outputs a specific timing pulse necessary for displaying the image. Synchronously, the triangular pulse generation circuit 162 outputs a pixel drive voltage of triangular waveform. The OLED display panel 160, using these signals, displays in real time the display data generated from the 6-bit image data on the pixel matrix 161 as mentioned in the discussion of the first embodiment. Here, the secondary battery 157 supplies the power for driving the whole animation display device 150.

This embodiment allows a satisfactory display of animated images, and provides the animation display device 150 that sufficiently suppresses irregularities of the display quality among pixels.

Further, this embodiment employs the OLED display panel described in the first embodiment as the image display device; however, obviously, various display panels described in the other embodiments can be incorporated into this embodiment.

According to this invention, it is possible to provide an image display device that has a satisfactory display quality of animated images and sufficiently suppresses the irregularities of the display quality among pixels.

The principles, preferred embodiments and modes of operation of the present invention have been described in the foregoing specification. However, the invention which is intended to be protected is not limited to the particular embodiments disclosed. The embodiments described herein are illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. An image display device comprising:

a pixel connects to a signal line inputting an image data signal, a reset line, a light-on switch line, an input switch line, and a power supply line, the pixel having an organic light emitting diode, an input switch controlled by the input switch line, a drive TFT to which current is supplied from the power supply line to the organic light emitting diode, a pixel capacitor arranged between the input switch and a gate electrode of the drive TFT, and a light-on switch controlled by signal on the light-on switch line, a signal data on the signal line is inputted to a gate electrode of the drive TFT via the input TFT switch and the pixel capacitor, a source of the drive TFT is connected to the power supply line, a drain of the drive TFT is connected to one electrode of the organic light emitting diode, the other electrode of the organic light emitting diode is connect to common terminal, the light-on switch is provided between the drive TFT and the organic light emitting diode, a reset switch which is controlled by the reset line arranged between the gate and the drain of the drive TFT, and a retention capacitor arranged between the gate and the source of the drive TFT.

2. An image display device according to claim 1, wherein the reset line and the input switch line connect to a scanning output of a gate drive circuit, the signal line connect to a signal drive circuit.

3. An image display device according to claim 1, wherein the drive TFT is polycrystalline silicon thin film transistor.

* * * * *